US011663974B2

(12) United States Patent
Wu et al.

(10) Patent No.: US 11,663,974 B2
(45) Date of Patent: May 30, 2023

(54) CORRECTION METHOD, CORRECTION APPARATUS AND CORRECTION SYSTEM OF CATHODE VOLTAGE, DISPLAY MODULE AND METHOD OF ADJUSTING BRIGHTNESS THEREOF

(71) Applicant: BOE TECHNOLOGY GROUP CO., LTD., Beijing (CN)

(72) Inventors: Baoyun Wu, Beijing (CN); Zebang Guo, Beijing (CN); Hui Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/477,955

(22) Filed: Sep. 17, 2021

(65) Prior Publication Data

US 2022/0084467 A1 Mar. 17, 2022

(30) Foreign Application Priority Data

Sep. 17, 2020 (CN) ..... 202010982450.0

(51) Int. Cl.
*G09G 3/3258* (2016.01)
*G09G 3/3291* (2016.01)
(Continued)

(52) U.S. Cl.
CPC ..... *G09G 3/3258* (2013.01); *G09G 3/3291* (2013.01); *G09G 5/10* (2013.01); *G09G 2320/0626* (2013.01)

(58) Field of Classification Search
CPC ..... G09G 3/3258; G09G 3/3291; G09G 5/10; G09G 2320/0626; G09G 3/006;
(Continued)

(56) References Cited

U.S. PATENT DOCUMENTS 9,347,828 B1 * 5/2016 Zhao ..... G01J 1/18
2017/0206825 A1 * 7/2017 Cha ..... G09G 3/3208
(Continued)

FOREIGN PATENT DOCUMENTS

CN 104392689 3/2015
CN 105304025 2/2016
(Continued)

OTHER PUBLICATIONS

Chinese Decision of Rejection (w/ English translation) for corresponding Chinese Application No. 202010982450.0, 14 pages.
(Continued)

*Primary Examiner* — Antonio Xavier
(74) *Attorney, Agent, or Firm* — Dority & Manning, P.A.

(57) ABSTRACT

A correction method of a cathode voltage is provided, including: controlling an image generator to send a first image test signal including a cathode voltage to a display module to be tested at each brightness level of the display module to be tested; controlling an optical measuring device to measure a first display parameter of the image displayed by the display module to be tested according to the first image test signal; obtaining the first display parameter from the optical measuring device, and determining whether the first display parameter is within a display parameter threshold ramie; progressively adjusting the cathode voltage according to a determination result, and using a second image test signal including an adjusted cathode voltage to test the display module to be tested and obtain a second display parameter until a corrected cathode voltage at a current brightness level is obtained.

10 Claims, 11 Drawing Sheets

(51) Int. Cl.
*G09G 5/10* (2006.01)
*G09G 3/00* (2006.01)

(58) Field of Classification Search
CPC ... G09G 2320/0276; G09G 2320/0673; G09G 2330/021; G09G 2330/028; G09G 3/3208; G09G 3/3225; G01M 11/02
See application file for complete search history.

(56) References Cited

U.S. PATENT DOCUMENTS

| | | | | |
|---|---|---|---|---|
| 2018/0308429 | A1* | 10/2018 | Meng | G09G 3/3406 |
| 2020/0005691 | A1* | 1/2020 | Yoo | G09G 3/006 |
| 2020/0243010 | A1* | 7/2020 | Lee | G09G 3/3233 |
| 2021/0082373 | A1* | 3/2021 | Lou | G09G 5/10 |

FOREIGN PATENT DOCUMENTS

| | | |
|---|---|---|
| CN | 106803418 | 6/2017 |
| CN | 110689849 | 1/2020 |
| CN | 111128075 | 5/2020 |

OTHER PUBLICATIONS

Chinese First Office Action (w/ English translation) for corresponding Chinese Application No. 202010982450.0, 22 pages.

* cited by examiner

CORRECTION METHOD, CORRECTION APPARATUS AND CORRECTION SYSTEM OF CATHODE VOLTAGE, DISPLAY MODULE AND METHOD OF ADJUSTING BRIGHTNESS THEREOF

CROSS-REFERENCE TO RELATED APPLICATION

This application claims priority to Chinese Patent Application No. 202010982450.0, filed on Sep. 17, 2020, titled "CORRECTION METHOD AND SYSTEM OF OLED CATHODE VOLTAGE, DISPLAY MODULE, AND BRIGHTNESS ADJUSTMENT METHOD", which is incorporated herein by reference in its entirety.

TECHNICAL FIELD

The present disclosure relates to the field of display technologies, and in particular, to a correction method, a correction apparatus and a correction system of a cathode voltage, a display module and a method of adjusting brightness thereof.

BACKGROUND

An organic light-emitting diode (OLED) display apparatus needs to be driven by a driving voltage to display an image. The driving voltage includes an anode voltage and a cathode voltage, and a voltage difference between the anode voltage and the cathode voltage is referred to as a cross voltage. In the process of displaying the image by the display apparatus, the larger the cross voltage is, the better the display effect of the image is. However, the corresponding power consumption of the display apparatus will also increase. When the voltage across is reduced, the power consumption will be reduced, but the display frame of the image may have problems of abnormal display such as yellowish or greenish.

SUMMARY

In an aspect, a correction method of a cathode voltage is provided. The correction method includes: controlling an image generator to send a first image test signal to a display module to be tested at each brightness level of the display module to be tested, the first image test signal including a cathode voltage, and being configured to drive the display module to be tested to display an image; controlling an optical measuring device to measure a first display parameter of the image displayed by the display module to be tested according to the first image test signal; obtaining the first display parameter from the optical measuring device, and determining whether the first display parameter is within a display parameter threshold range; progressively adjusting the cathode voltage according to a determination result, and using a second image test signal including an adjusted cathode voltage to test the display module to be tested and obtain a second display parameter until a corrected cathode voltage at a current brightness level is obtained, the corrected cathode voltage being a maximum cathode voltage corresponding to the displayed image corresponding to at least one display parameter, among all the first display parameter and the second display parameters, within the display parameter threshold range.

In some embodiments, the determination result is that the first display parameter is within the display parameter threshold range. Progressively adjusting the cathode voltage according to the determination result includes: progressively adjusting the cathode voltage with a first preset step value.

In some embodiments, using the second image test signal including the adjusted cathode voltage to test the display module to be tested and obtain the second display parameter until the corrected cathode voltage at the current brightness level is obtained, includes: controlling the image generator to send the second image test signal including the adjusted cathode voltage to the display module to be tested; obtaining, from the optical measuring device, the second display parameter of the image displayed by the display module to be tested according to the second image test signal; determining whether the second display parameter is within the display parameter threshold range; in response to determining that the second display parameter is within the display parameter threshold range, adjusting the cathode voltage with the first preset step value again, using a second image test signal including a re-adjusted cathode voltage to test the display module to be tested and obtain a second display parameter until the second display parameter is not within the display parameter threshold range, and using a cathode voltage in the second image test signal on which a previous test of the current test is based as the corrected cathode voltage; and in response to determining that the second display parameter is not within the display parameter threshold range, using a preset reference cathode voltage as the corrected cathode voltage, the reference cathode voltage being the cathode voltage included in the first image test signal.

In some embodiments, the cathode voltage is negative, and the first preset step value is positive.

In some embodiments, the determination result is that the first display parameter is not within the display parameter threshold range. Progressively adjusting the cathode voltage according to the determination result includes: progressively adjusting the cathode voltage with a second preset step value.

In some embodiments, using the second image test signal including the adjusted cathode voltage to test the display module to be tested and obtain the second display parameter until the corrected cathode voltage at the current brightness level is obtained, includes: controlling the image generator to send the second image test signal including the adjusted cathode voltage to the display module to be tested; obtaining, from the optical measuring device, the second display parameter of the image displayed by the display module to be tested according to the second image test, determining whether the second display parameter is within the display parameter threshold range; in response to determining that the second display parameter is not within the display parameter threshold range, adjusting the cathode voltage with the second preset step value again, using a second image test signal including a re-adjusted cathode voltage to test the display module to be tested and obtain a second display parameter until the second display parameter is within the display parameter threshold range, and using a cathode voltage in the second image test signal on which the current test is based as the corrected cathode voltage; and in response to determining that the second display parameter is within the display parameter threshold range, using the adjusted cathode voltage as the corrected cathode voltage.

In some embodiments, the cathode voltage is negative, and the second preset step value is negative.

In some embodiments, the first display parameter and the second display parameter are each a chromaticity coordinate parameter corresponding to the image displayed by the display module to be tested under driving of a current cathode voltage, and the display parameter threshold range is a range of a standard chromaticity coordinate parameter corresponding to an image in an ideal state.

In some embodiments, the correction method further includes storing a corrected cathode voltage parameter corresponding to each brightness level into the display module, the corrected cathode voltage parameter being a parameter corresponding to the corrected cathode voltage.

In some embodiments, the correction method further includes adjusting a gamma curve corresponding to each brightness level based on the corrected cathode voltage at the brightness level.

In some embodiments, the correction method further includes storing the adjusted gamma curve corresponding to each brightness level into the display module.

In another aspect, a correction apparatus of a cathode voltage is provided. The correction apparatus includes an image generator and a controller. The image generator is configured to generate image information, obtain a cathode voltage corresponding to the first image information, and send a first image test signal including the image information and the cathode voltage to a display module to be tested. The controller is configured to control an optical measuring device to measure a first display parameter of an image displayed by the display module to be tested according to the first image test signal, obtain the first display parameter from the optical measuring device, determine whether the first display parameter is within a display parameter threshold range, progressively adjust the cathode voltage according to a determination result, and send the adjusted cathode voltage to the image generator. The image generator is further configured to obtain the adjusted cathode voltage, and send a second image test signal including the adjusted cathode voltage to the display module to be tested. The controller is further configured to use the second image test signal to test the display module to be tested, and obtain a second display parameter until a corrected cathode voltage at a current brightness level is obtained. The corrected cathode voltage is a maximum cathode voltage corresponding to the displayed image corresponding to at least one display parameter, among all the first display parameter and the second display parameters, within the display parameter threshold range.

In yet another aspect, a correction system of a cathode voltage is provided. The correction system includes the correction apparatus described in the preceding embodiments and the optical measurement device. The optical measuring device is configured to measure a display parameter of the image displayed by the display module to be tested in response to a test instruction from the correction apparatus, and output the display parameter to the correction apparatus. The display parameter includes the first display parameter and the second display parameter.

In yet another aspect, a display module is provided. The display module includes a driving chip, a power supply chip and a display panel. The driving chip is configured to store a plurality of brightness levels and a corrected cathode voltage parameter corresponding to each brightness level, determine a brightness level of a target image in response to a received brightness adjustment instruction, and output the corrected cathode voltage parameter corresponding to the determined brightness level. The power supply chip is configured to receive the corrected cathode voltage parameter, and output a corresponding corrected cathode voltage signal according to the corrected cathode voltage parameter, the corrected cathode voltage signal includes a corrected cathode voltage. The display panel is configured to receive the correction cathode voltage signal and display an image at the corrected cathode voltage.

In some embodiments, the driving chip includes an instruction receiver, a memory, a processor, and a power controller. The instruction receiver is configured to receive the brightness adjustment instruction from the host. The memory is configured to store a configuration table, and the configuration table includes the plurality of brightness levels, and the corrected cathode voltage parameter and a gamma curve corresponding to each brightness level. The processor is configured to determine the brightness level of the target image in response to the brightness adjustment instruction, query the memory according to the determined brightness level, and obtain the corrected cathode voltage parameter corresponding to the brightness level. The power controller is configured to send the corrected cathode voltage parameter obtained by the processor to the power supply chip.

In some embodiments, the memory includes a plurality of registers, and each register corresponds to one brightness level. The register includes a plurality of gamma curve value storage bits and a voltage parameter storage bit. Each gamma curve value storage bit is configured to store a curve value corresponding to a node on the gamma curve corresponding to the brightness level. The voltage parameter storage bit is configured to store the corrected cathode voltage parameter corresponding to the brightness level.

In yet another aspect, a method of adjusting brightness of a display module is provided, the display module is the display module described in any of the preceding embodiments. The method includes: the driving chip determining the brightness level of the target image in response to the received brightness adjustment instruction from the host, and outputting the corrected cathode voltage parameter corresponding to the brightness level; the power supply chip outputting the corresponding corrected cathode voltage signal according to the corrected cathode voltage parameter, the corrected cathode voltage signal including the corrected cathode voltage; and the display panel receiving and loading the corrected cathode voltage signal to display the image at the corrected cathode voltage.

In some embodiments, the driving chip includes a processor, an instruction receiver, a memory, and a power controller. The driving chip determining the brightness level of the target image in response to the received brightness adjustment instruction from a host, and outputting the corrected cathode voltage parameter corresponding to the brightness level, including: the processor determining the brightness level of the target image in response to the brightness adjustment instruction received by the instruction receiver; the processor querying the memory according to the determined brightness level, and obtaining the corrected cathode voltage parameter corresponding to the brightness level; and the processor transmitting the corrected cathode voltage parameter to the power supply chip through the power controller.

In yet another aspect, a computer-readable storage medium is provided, which stores a computer program. When the computer program is executed by a processor, the correction method as described in any of the preceding embodiments is achieved. Or, when the computer program is executed by the processor, the method of adjusting the brightness as described in any of the preceding embodiments is achieved.

In yet another aspect, a computer device is provided, which includes a memory, a processor, and a computer program stored on the memory and running on the processor. When the processor executes the computer program, the correction method as described in any of the preceding embodiments is achieved. Or, when the processor executes the computer program, the method of adjusting the brightness as described in any of the preceding embodiments is achieved.

BRIEF DESCRIPTION OF THE DRAWINGS

In order to describe technical solutions in the present disclosure more clearly, the accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings.

DETAILED DESCRIPTION

Technical solutions in some embodiments of the present disclosure will be described clearly and completely below with reference to the accompanying drawings. However, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

As used herein, the term if is optionally construed as "when" or "in a case where" or "in response to determining that" or "in response to detecting", depending on the context. Similarly, the phrase "if it is determined that" or "if [a stated condition or event] is detected" is optionally construed as "in a case where it is determined that" or "in response to determining that" or "in a case where [the stated condition or event] is detected" or "in response to detecting [the stated condition or event]", depending on the context.

The use of "applicable to" or "configured to" herein means an open and inclusive expression, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values exceeding those stated.

The term such as "about", "substantially" or "approximately" as used herein includes a stated value and an average value within an acceptable range of deviation of a particular value. The acceptable range of deviation is determined by a person of ordinary skill in the art in view of measurement in question and errors associated with measurement of a particular quantity (i.e., limitations of a measurement system).

Figure 1:
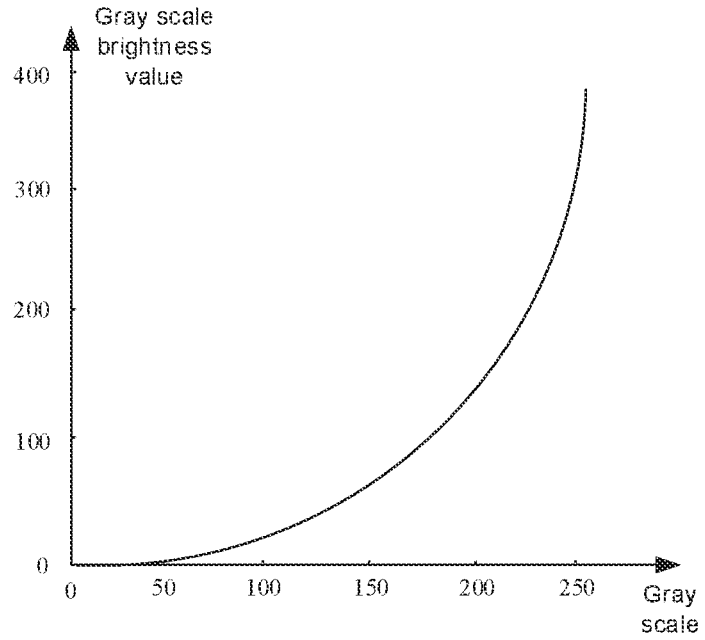
FIG. 1 is a graph of a gamma curve, in accordance with some embodiments.

Since human eyes are much more sensitive to the brightness in a dark environment than to the brightness in a bright environment, a relationship between human eye perception and brightness is not a linear relationship, but presents a certain rule. As shown in FIG. 1, FIG. 1 shows a gamma curve, in which a horizontal axis represents a pixel gray scale value input to a pixel (hereinafter referred to as a gray scale), and a vertical axis represents a gray scale brightness value correspondingly output by the pixel. In order to make display effect of the display apparatus meet visual perceptions of human eyes, a relationship between the input gray scale and the corresponding output gray scale brightness value needs to be set as that the gray scale brightness value is proportional to $\gamma$ power of the gray scale. The relationship between the gray scale brightness value and the gray scale is referred to as a gamma curve of a display apparatus, and a $\gamma$ value is also referred to as a Gamma value. For example, the $\gamma$ value is set to $2.2\pm0.2$ that means a value within a range of a difference of 2.2 and 0.2 to a sum of 2.2 and 0.2, so as to make displayed images close to images actually seen by the human eyes.

On this basis, before the shipment of the display apparatus, the display apparatus needs to be performed a gamma tuning, so as to adjust the $\gamma$ value in the relationship between the gray scale brightness value and the gray scale to a target value, for example, to $2.2\pm0.2$. As a result, the display effect of the display apparatus may be improved.

Generally, a display panel of the display apparatus has a brightness adjustment range, and a brightness level of the display apparatus may be changed within the brightness adjustment range, so that the image is displayed at different brightness levels. Ideally, the gamma value of the gamma curve corresponding to each brightness level within the brightness adjustment range meets the target value, (e.g., 2.2±0.2). In this way, the display effect presented by the display apparatus accords with the visual perception of human eyes at each brightness level.

In an actual process of the gamma tuning, the gamma value of the gamma curve may be adjusted by adjusting the gray scale brightness value of the pixel, so that the gamma value of the gamma curve corresponding to each brightness level meets the target value (e.g., 2.2±0.2). The pixel emits light under driving of a driving signal. The gray scale brightness value of the pixel may be adjusted by changing the driving signal output by a driving integrated circuit (IC) of the display apparatus to each pixel.

A driving voltage of the display apparatus includes an anode voltage and a cathode voltage, and a voltage difference therebetween is referred to as a cross voltage. In order to reduce the power consumption of the display apparatus on a premise of ensuring the display effect, for example, a magnitude of a cross voltage may be changed by adjusting a magnitude of a cathode voltage. Therefore, in some embodiments, different cathode voltages are dynamically adjusted and called for different display images.

Figure 2:
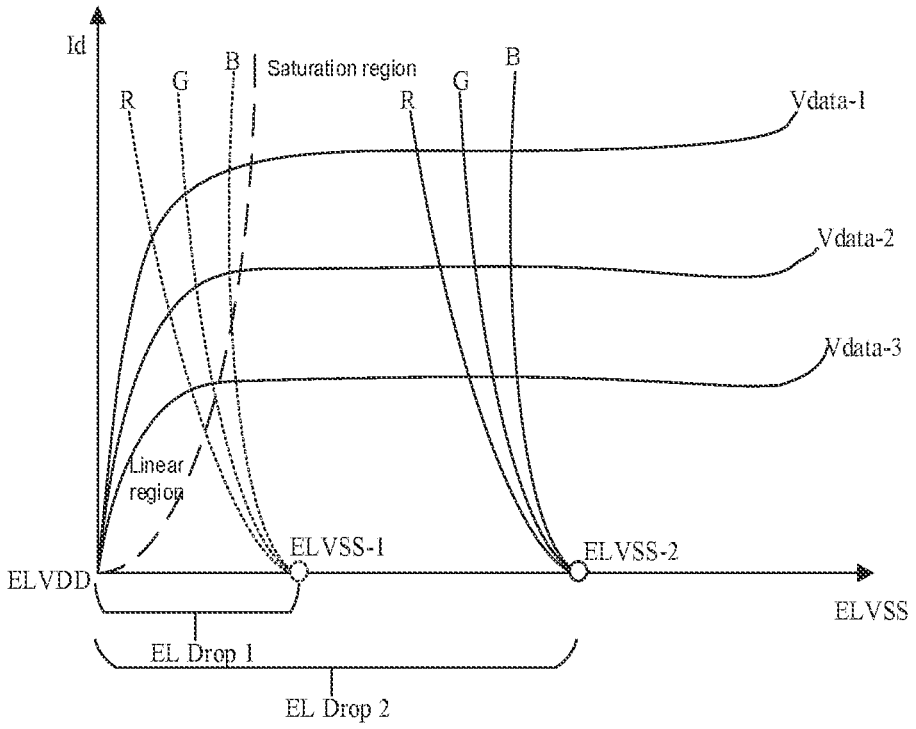
FIG. 2 is graph of output characteristics curve of a driving transistor, in accordance with some embodiments.

FIG. 2 illustrates the principle of how the pixel is affected by a driving voltage in the driving signal, and it shows the output characteristic curve of a driving transistor (i.e., a transistor that drives the pixel to emit light) in the display apparatus. As shown in FIG. 2, the output characteristic curve includes a linear region and a saturation region. When the display apparatus is displaying normally, it is required that the operation state of the driving transistor should be in the saturation region, so that the output Vdata-n (n is a positive integer and is equal to 1, 2, or 3) has a stable signal instead of an unstable signal affected by the magnitude of the driving voltage.

As shown in FIG. 2, in a case where the anode voltage ELVDD is constant, the cathode voltage is negative at different cathode voltages ELVSS. The smaller the cathode voltage (e.g., ELVSS-2) is, the larger the span (e.g., EL Drop 2) between the anode voltage and the cathode voltage is (i.e., the larger the cross voltage is). The load curves of the pixels all fall in the saturation region under the driving voltage, but the larger the span is, the larger the power consumption is. The larger the cathode voltage (e.g., ELVSS-1) is, the smaller the span (e.g., EL Drop 1) between the anode voltage and the cathode voltage is (i.e., the smaller the cross voltage is). The load curves of the pixels all fall in the linear region under the driving voltage, which causes the color cast of the display images such as yellowish and greenish images and other abnormal display problems. On this basis, in the case where the anode voltage is constant, it is necessary to set a small cathode voltage to ensure that the load curves of the pixels at all brightness levels fall in the saturation region, which makes the power consumption of the display apparatus very large.

Therefore, by dynamically adjusting the cathode voltage, the pixel at different brightness levels corresponds to different cathode voltages. As a result, the cathode voltage may be increased, the cross voltage may be reduced, and the power consumption may be reduced to a certain extent while the normal display is ensured (the load curve falls in the saturation region).

In the related art, the cathode voltage is dynamically adjusted by adopting a preset value; that is, in the initial stage of designing the display apparatus, a set of cathode voltage parameters are preset, and when all subsequent products display images, the parameters are called from the set of cathode voltage parameters to obtain different cathode voltages. In this way, different images correspond to different cross voltages during the display process, and the power consumption of the display apparatus may be reduced to a certain extent. For example, the method of dynamically adjusting the cathode voltage is to: preset a set of cathode voltage parameters; use multiple samples (e.g., display apparatuses) to verify the set of cathode voltage parameters; apply the set of cathode voltage parameters to all products (e.g., display apparatuses) if the verification result shows that the set of cathode voltage parameters can reduce the power consumption to a certain extent.

However, it has been found through research that the above method of dynamically adjusting the cathode voltage has many defects. For example, firstly, the number of the samples involved in the verification is restricted, and the parameters after verification are not fully applicable to all the products; therefore, a preset set of cathode voltage parameters may be unreasonable, some products other than the samples cannot achieve the expected effect of reducing power consumption, and in severe cases, the display effect of the product may deteriorate, or even display abnormally. Secondly, with such method of setting the preset value, in the subsequent use process of products, a host (e.g., a CPU) needs to transmit different cathode voltage parameters to the product at any time according to different brightness feedback of the product (e.g., the display brightness of the display screen of the electronic terminal device is adjusted by dragging the brightness slider on the display screen of the electronic terminal device, such as a mobile phone), which greatly increases the workload of the host, and has low versatility. Thirdly, due to the process fluctuation in the process of manufacturing the product, there will be certain differences among the products, and the more obvious the process fluctuation is, the larger the differences among the products are; therefore, the uniform preset parameters will cause yield loss of some products.

Figure 3A:
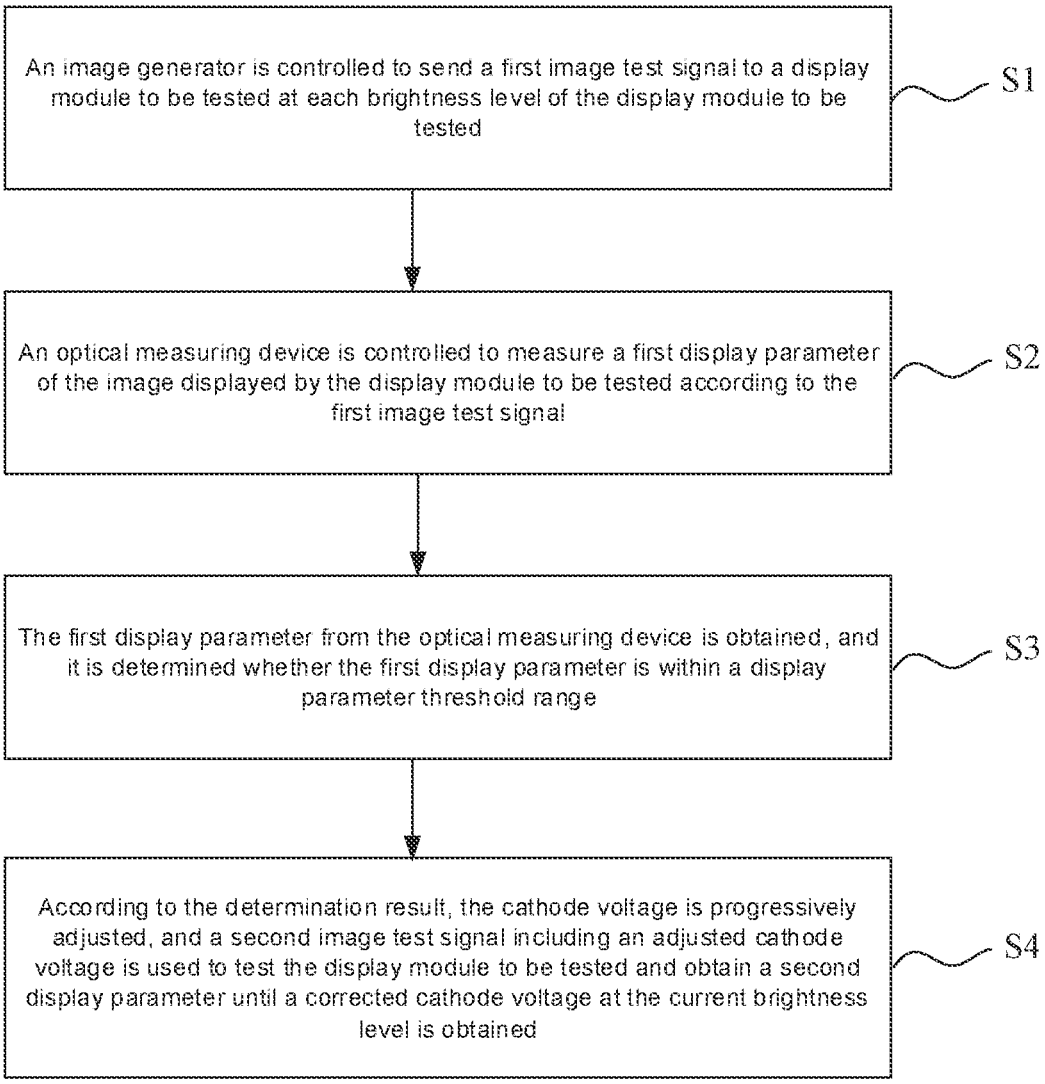
FIG. 3A is a flow diagram of a correction method of a cathode voltage, in accordance with some embodiments.

In order to solve the above technical problem, some embodiments of the present disclosure provide a correction method of the cathode voltage, which is used for correcting the cathode voltage of the display module to be tested. As shown in FIG. 3A, the correction method includes the following steps S1 to S4.

In S1, an image generator is controlled to send a first image test signal to a display module to be tested at each brightness level of the display module to be tested.

In some embodiments, the first image test signal includes the cathode voltage, and the first image test signal is configured to drive the display module to be tested to display an image at the cathode voltage. The first image test signal is an image test signal sent for the first time, and the cathode voltage included in the first image test signal is a preset reference cathode voltage.

It will be noted that, according to the displayed image driven by the image test signal, the cathode voltage may include one voltage value (for example, when the display image has only one color), or include multiple voltage values (for example, when the displayed image has multiple colors). The embodiments of the present disclosure are described by taking the cathode voltage including one voltage value as an example, but the protection scope is not limited thereto.

In S2, an optical measuring device is controlled to measure a first display parameter of the image displayed by the display module to be tested according to the first image test signal.

For example, the first image test signal includes the cathode voltage and an anode voltage. The cathode voltage is applied to the cathode of the display module to be tested, and the anode voltage is applied to the anode of the display module to be tested. In this way, the display module to be tested may display the image under the driving of the first image test signal.

In S3, the first display parameter from the optical measuring device is obtained, and it is determined whether the first display parameter is within a display parameter threshold range.

It will be noted that, whether the first display parameter is within a display parameter threshold range can be used to evaluate whether the display effect of the display module to be tested is qualified. If the first display parameter is within the display parameter threshold range, it means that the display effect is qualified, and if the first display parameter is not within the display parameter threshold range, it means that the display effect is unqualified. In exemplary embodiments, a chromaticity coordinate parameter of an image may be used as the display parameter to evaluate whether the display effect is qualified.

The determination result in S3 includes: the first display parameter is within the display parameter threshold range; or the first display parameter is not within the display parameter threshold range; or the first display parameter is not obtained within a preset time.

In some embodiments, the display parameter is a chromaticity coordinate parameter corresponding to the image displayed by the display module to be tested under driving of the current cathode voltage, and the display parameter threshold range is a range of a standard chromaticity coordinate parameter corresponding to the image in an ideal state. The display parameter includes the first display parameter and a second display parameter mentioned below.

The display parameter threshold may be a threshold of an optical spatial chromaticity coordinate when the display apparatus can normally display in an optical index of a gray scale 255 image. Those skilled in the art should understand that, the display parameter threshold may be set corresponding to parameters that can be measured by the optical measuring device, which is not limited, as long as it can reflect a threshold of the brightness information of the display module to be tested during normal display. The display parameter threshold range may be set according to the above display parameter threshold. For example, a fluctuation range is obtained by fluctuating a specific value before and after the display parameter threshold, and the fluctuation range is used as the display parameter threshold range, and the fluctuated value may be set based on experience and actual conditions.

It will be noted that, the chromaticity coordinate is a coordinate of colors, also referred to as a color system. In commonly used color coordinates now, the horizontal axis is X, the vertical axis is Y, and (X, Y) is used to represent a color. National Television Standards Committee (NTSC) stipulates that a standard red chromaticity coordinate is (0.67, 0.33), a standard green chromaticity coordinate is (0.21, 0.71), a standard blue chromaticity coordinate is (0.14, 0.08), and a pure white chromaticity coordinate is (0.33, 0.33). That is, in the chromaticity coordinate, in a case where a value of the horizontal axis X and a value of the vertical axis Y are both around 0.3, in the chromaticity coordinate, a displayed color is white. In a case where the value of the horizontal axis X is greater than 0.3 and greater than the value of the vertical axis Y (it can also be said that X is greater than Y), in the chromaticity coordinate, the displayed color is reddish. In a case where the value of the vertical axis Y is greater than 0.3 and greater than the value of the horizontal axis X (it can also be said that X is less than Y), in the chromaticity coordinate, the displayed color is greenish).

By determining a relation between the display parameter and the display parameter threshold range, it may be determined whether the color of the image displayed at the cathode voltage is displayed according to the standard chromaticity coordinate, that is, whether there is a color cast in the color of the image displayed at the cathode voltage and whether the image is normally displayed. In this way, cathode voltages which enable the image to be displayed normally are filtered out, that is, cathode voltages which enable the load curve of the pixel to be in the saturation region of the driving transistor are filtered out. Then, through progressive adjustment, the maximum value of the cathode voltages that enable the image to be displayed normally is obtained, so that the cross voltage may be reduced, and the power consumption may be reduced.

In S4, according to the determination result, the cathode voltage is progressively adjusted, and a second image test signal including an adjusted cathode voltage is used to test the display module to be tested and obtain a second display parameter until a corrected cathode voltage at the current brightness level is obtained.

In some embodiments, the second image test signal is an image test signal that is not sent for the first time, and includes the adjusted cathode voltage. It is understandable that in the correction method of the cathode voltage, only one second image test signal may need to be sent, or multiple second image test signals may need to be sent, which needs to be determined according to the display effect of the image displayed by the display module to be tested based on the second image test signal.

In some embodiments, the corrected cathode voltage is a maximum cathode voltage corresponding to the displayed image corresponding to at least one display parameter, among all the first display parameter and the second display parameters, within the display parameter threshold range. That is, the maximum value of the cathode voltages corresponding to the displayed image on the premise that the display effect of the display module to be tested is qualified.

Figure 3B:
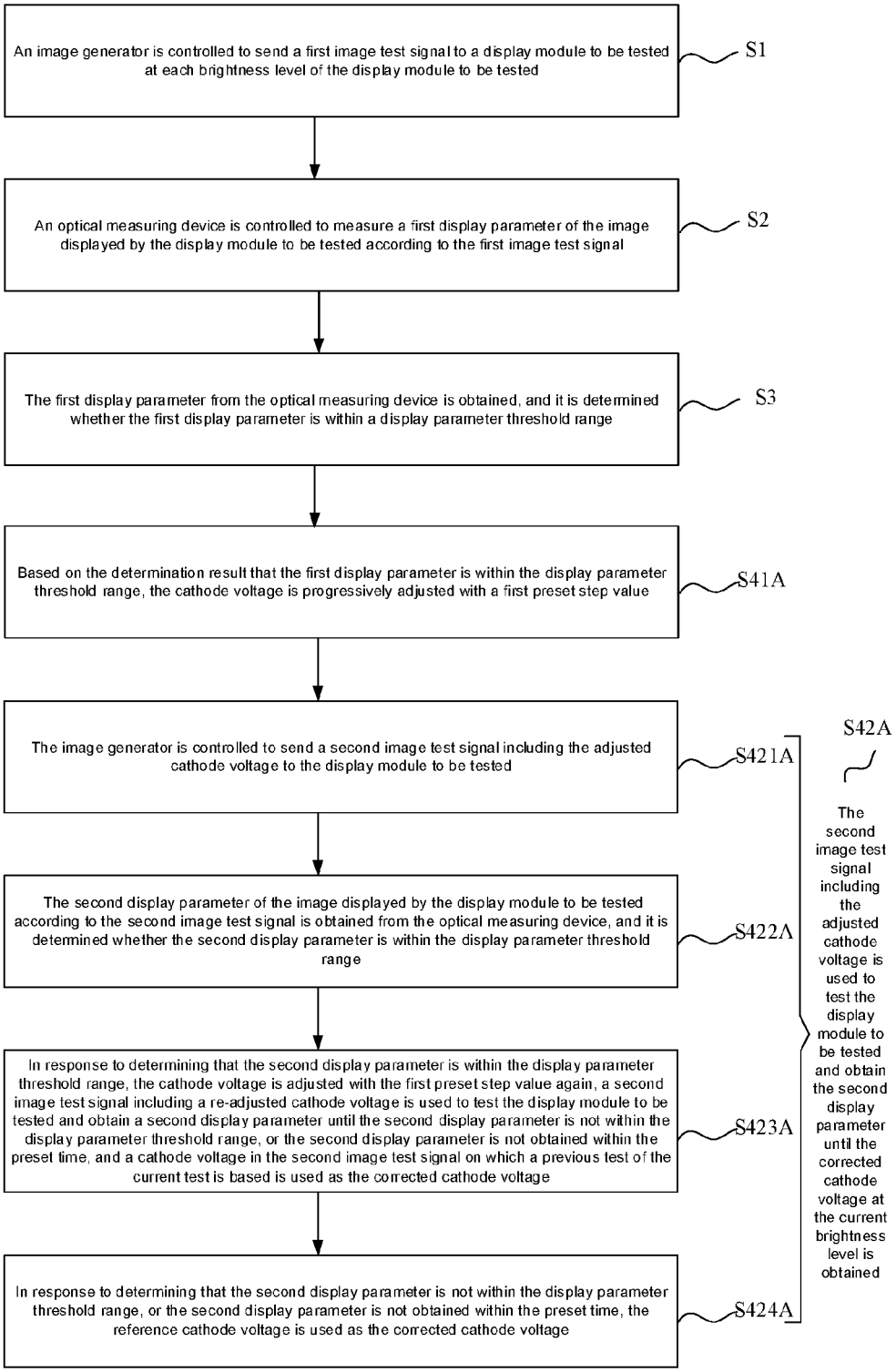
FIG. 3B is a flow diagram of another correction method of a cathode voltage, in accordance with some embodiments.
Figure 3C:
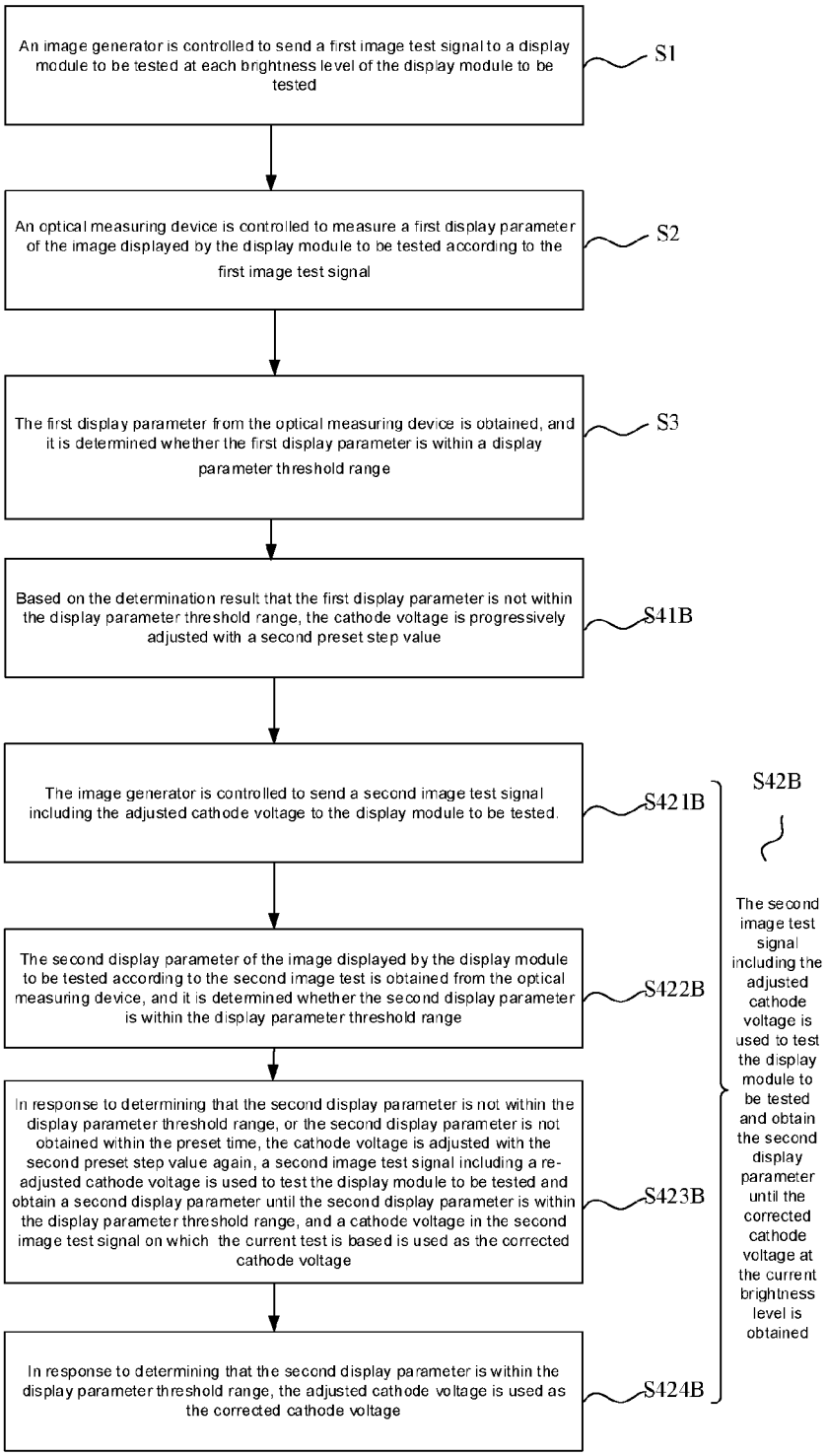
FIG. 3C is a flow diagram of yet another correction method of a cathode voltage, in accordance with some embodiments.

As shown in FIG. 3B, in some embodiments, S4 includes steps S41A and S42A.

In S41A, based on the determination result that the first display parameter is within the display parameter threshold range, the cathode voltage is progressively adjusted with a first preset step value.

In S42A, the second image test signal including the adjusted cathode voltage is used to test the display module to be tested and obtain the second display parameter until the corrected cathode voltage at the current brightness level is obtained.

The cathode voltage is negative, and the first preset step value is positive. That is, the cathode voltage is increased with the first preset step value. For example, the cathode voltage is increased from −5V to −4V.

By determining the magnitude of the display parameter of the image displayed on the display module to be tested, the display effect of the image may be detected, and the maximum value of the cathode voltages that enable the image to be displayed normally may be found according to the display effect, thereby reducing the power consumption. In a case where the display effect of the image meets the preset condition, the load curve of the corresponding pixel is in the saturation region of the characteristic curve of the driving transistor. In this case, the cathode voltage is adjusted with the first preset step value, so that the load curve of the pixel gradually approaches the linear region of the characteristic curve of the driving transistor. A cathode voltage corresponding to the load curve of the pixel closest to the linear region of the characteristic curve of the driving transistor is selected as the corrected cathode voltage at the current brightness level, so as to achieve a purpose of obtaining the maximum value of the cathode voltages while meeting the display effect, and thereby reducing the power consumption to the greatest extent.

As shown in FIG. 3B, in the exemplary embodiments, S42A includes steps S421A to S424A.

In S421A, the image generator is controlled to send the second image test signal including the adjusted cathode voltage to the display module to be tested.

In S422A, the second display parameter of the image displayed by the display module to be tested according to the second image test signal is obtained from the optical measuring device, and it is determined whether the second display parameter is within the display parameter threshold range.

In S423A, in response to determining that the second display parameter is within the display parameter threshold range, the cathode voltage is adjusted with the first preset step value again, a second image test signal including a re-adjusted cathode voltage is used to test the display module to be tested and obtain a second display parameter until the second display parameter is not within the display parameter threshold range, or the second display parameter is not obtained within the preset time, and a cathode voltage in the second image test signal on which a previous test of the current test is based is used as the corrected cathode voltage.

In S424A, in response to determining that the second display parameter is not within the display parameter threshold range, or the second display parameter is not obtained within the preset time, the reference cathode voltage is used as the corrected cathode voltage.

The cathode voltage is negative, and the first preset step value is positive.

In a case where the display effect of the image is qualified, the load curve of the corresponding pixel is in the saturation region of the characteristic curve of the driving transistor. In this case, the cathode voltage is adjusted with the first preset step value, so that the load curve of the pixel approaches the linear region of the characteristic curve of the driving transistor by a first preset step value. Then, it is tested again whether the adjusted cathode voltage is capable of driving the image to be displayed normally.

If the display effect after test again does not meet the normal display effect of the image, it means that the load curve of the pixel corresponding to the adjusted cathode voltage is already in the linear region of the characteristic curve of the driving transistor. It can be seen that the cathode voltage before adjustment (i.e., the reference cathode voltage) is the maximum cathode voltage that enables the load curve of the pixel to be in the saturation region of the characteristic curve of the driving transistor. Therefore, the reference cathode voltage can be used as the corrected cathode voltage at the brightness level.

If the display effect after test again still meets the normal display effect of the image, it means that the load curve of the pixel corresponding to the adjusted cathode voltage is still in the saturation region of the characteristic curve of the driving transistor. Therefore, the load curve may continue to approach the linear region, that is, the cathode voltage may further be adjusted with the first preset step value (i.e., increasing the cathode voltage), until the adjusted cathode voltage cannot drive the image to be display normally. In this case, the load curve of the pixel corresponding to the adjusted cathode voltage is in the linear region of the characteristic curve of the driving transistor. It can be seen that the cathode voltage before adjustment is the maximum cathode voltage that enables the image to be displayed normally. Therefore, the cathode voltage before the adjustment is used as the corrected cathode voltage.

As shown in FIG. 30, in some other embodiments, S4 includes steps S41B and S42B.

In S41B, based on the determination result that the first display parameter is not within the display parameter threshold range, the cathode voltage is progressively adjusted with a second preset step value.

In S42B, the second image test signal including the adjusted cathode voltage is used to test the display module to be tested and obtain the second display parameter until the corrected cathode voltage at the current brightness level is obtained.

The cathode voltage is negative, and the second preset step value is positive. That is, the cathode voltage is decreased with the second preset step value. For example, the cathode voltage is decreased from −3V to −4V.

It will be noted that the unit values of the first preset step value and the second preset step value may be the same, that is, the first preset step value and the second preset step value are only different in positive and negative. Of course, the unit values of the first preset step value and the second preset step value may also be different, which is not limited here.

By determining the magnitude of the display parameter of the image displayed on the display module to be tested, the display effect of the image may be detected, and the maximum value of the cathode voltage that enables the image to be displayed normally may be found according to the display effect, thereby reducing the power consumption. In a case where the display effect of the image does not meet the preset condition, the load curve of the corresponding pixel must be in the linear region of the characteristic curve of the driving transistor. In this case, the cathode voltage is adjusted with the second preset step value (i.e., decreasing the cathode voltage), so that the load curve of the pixel gradually approaches the saturation region of the characteristic curve of the driving transistor. A cathode voltage corresponding to the load curve of the pixel that is in the saturation region of the driving transistor and closest to the linear region is selected as the corrected cathode voltage at the current brightness level, so as to achieve a purpose of obtaining the maximum value of the cathode voltages while meeting the display effect, and thereby reducing the power consumption to the greatest extent.

As shown in FIG. 30, in the exemplary embodiments, S42B includes steps S421B to S424B.

In S421B, the image generator is controlled to send the second image test signal including the adjusted cathode voltage to the display module to be tested.

In S422B, the second display parameter of the image displayed by the display module to be tested according to the second image test is obtained from the optical measuring device, and it is determined whether the second display parameter is within the display parameter threshold range.

In S423B, in response to determining that the second display parameter is not within the display parameter threshold range, or the second display parameter is not obtained within the preset time, the cathode voltage is adjusted with the second preset step value again, a second image test signal including a re-adjusted cathode voltage is used to test the display module to be tested and obtain a second display parameter until the second display parameter is within the display parameter threshold range, and a cathode voltage in the second image test signal on which the current test is based is used as the corrected cathode voltage.

In S424B, in response to determining that the second display parameter is within the display parameter threshold range, the adjusted cathode voltage is used as the corrected cathode voltage.

The cathode voltage is negative, and the second preset step value is negative.

In a case where the display effect of the image is not qualified, the load curve of the corresponding pixel must be in the linear region of the characteristic curve of the driving transistor. In this case, the cathode voltage is adjusted with the second preset step value, so that the load curve of the pixel approaches the saturation region of the characteristic curve of the driving transistor by a second preset step value. Then, it is tested again whether the adjusted cathode voltage is capable of driving the image to be displayed normally.

If the display effect after test again meets the normal display effect of the image, it means that the load curve of the pixel corresponding to the adjusted cathode voltage is already in the saturation region of the characteristic curve of the driving transistor. It can be seen that the adjusted cathode voltage is the maximum cathode voltage that enables the load curve of the pixel to be in the saturation region of the characteristic curve of the driving transistor and closest to the linear region. Therefore, the adjusted cathode voltage can be used as the corrected cathode voltage at the brightness level.

If the display effect after test again does not still meet the normal display effect of the image, it means that the load curve of the pixel corresponding to the adjusted cathode voltage is still in the linear region of the characteristic curve of the driving transistor. Therefore, the load curve may continue to approach the saturation region, that is, the cathode voltage may further be adjusted with the second preset step value (i.e., decreasing the cathode voltage), until the adjusted cathode voltage can drive the image to be display normally. In this case, the adjusted cathode voltage is the maximum cathode voltage that enables the image to be displayed normally. Therefore, the adjusted cathode voltage can be used as the corrected cathode voltage at the brightness level.

Through S1 to S4, the cathode voltage is progressively adjusted, so that the same image may be displayed at multiple different cathode voltages at the same brightness level; by detecting the display effect of the image at the multiple different cathode voltages, the maximum value of the cathode voltages which can meet the normal display effect may be obtained. As a result, the purpose of reducing the power consumption to the maximum extent may be achieved while the image is displayed with high quality.

Figure 3D:
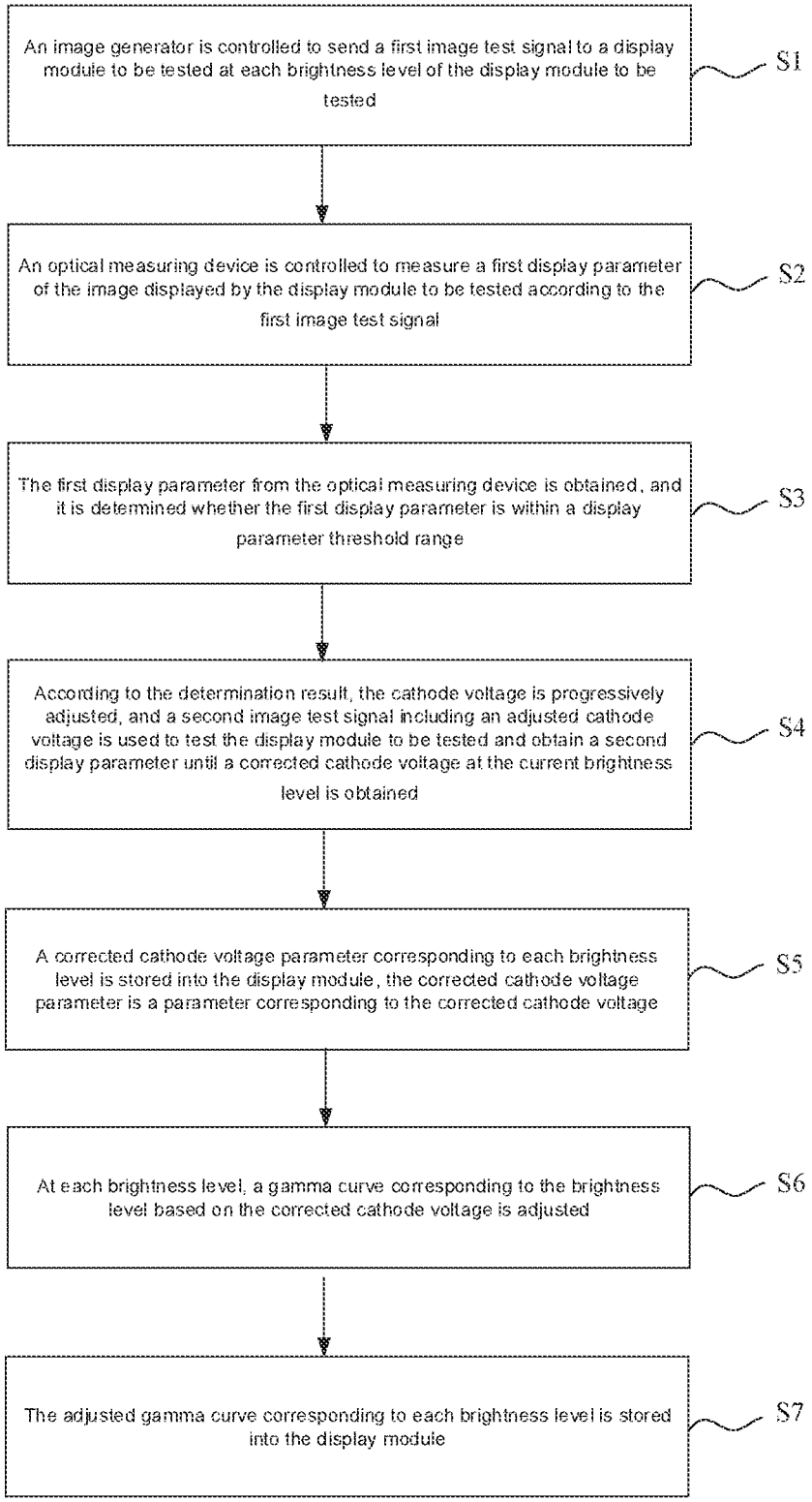
FIG. 3D is a flow diagram of yet another correction method of a cathode voltage, in accordance with some embodiments.

As shown in FIG. 3D, in some embodiments, the correction method further includes steps S5 to S7.

In S5, a corrected cathode voltage parameter corresponding to each brightness level is stored into the display module, the corrected cathode voltage parameter is a parameter corresponding to the corrected cathode voltage.

After obtaining the maximum value of the cathode voltages (i.e., the corrected cathode voltage) corresponding to each brightness level that enables the image to be displayed normally through the correction method, the corrected cathode voltage parameter corresponding to the corrected cathode voltage is stored into the display module. In the subsequent use process of the products, the product (e.g., the display module, or the display apparatus) directly calls the stored corrected cathode voltage parameter according to different brightness feedback (e.g., the display brightness of the display screen of the electronic terminal device is adjusted by dragging the brightness slider on the display screen of the electronic terminal device, such as a mobile phone) thereof and outputs a corresponding cathode voltage, without the need to be called, processed and sent by the host, which may reduce the task load of the host and further reduce the power consumption.

In S6, at each brightness level, a gamma curve corresponding to the brightness level based on the corrected cathode voltage is adjusted.

After obtaining the corrected cathode voltage, the gamma tuning is performed according to the gray scale brightness value of the pixel corresponding to the corrected cathode voltage to obtain the gamma curve that meets the target value, so that the display effect presented by the display apparatus accords with the visual perception of human eyes at each brightness level.

In S7, the adjusted gamma curve corresponding to each brightness level is stored into the display module.

In some embodiments, curve values (gray scale voltages corresponding to nodes) of multiple nodes on the gamma curve can be stored into the display module, and multiple line segments formed by connecting the multiple nodes in sequence are similar to the gamma curve and can replace the gamma curve. The gamma curve may be displayed according to the curve values of the nodes as long as there are enough nodes.

It will be noted that, any of the foregoing correction methods can be directly implemented by the existing gamma tuning system, without the need to additionally design a cathode voltage correction apparatus and the need of separate design processes, which may make the cost low. In addition, since every display module requires the gamma tuning, each display module may correct the cathode voltage according to the correction method of the cathode voltage. As a result, it may be ensured that each product has a completely applicable corrected cathode voltage parameter, which may ensure the display effect of each product, and avoid the yield loss of an individual product caused by the individual difference due to the process error.

In addition, the corrected cathode voltage parameters obtained by the correction method may be directly stored into the display module, which may omit a step of sending parameters by the host, simplify the dynamic calling processes of the product, and improve the versatility and convenience of the product. The above correction methods may reduce the power consumption of the product to the maximum extent, improve the display effect, and simplifying the calling steps for the cathode voltage, which may effectively improve the product competitiveness.

Figure 4A:
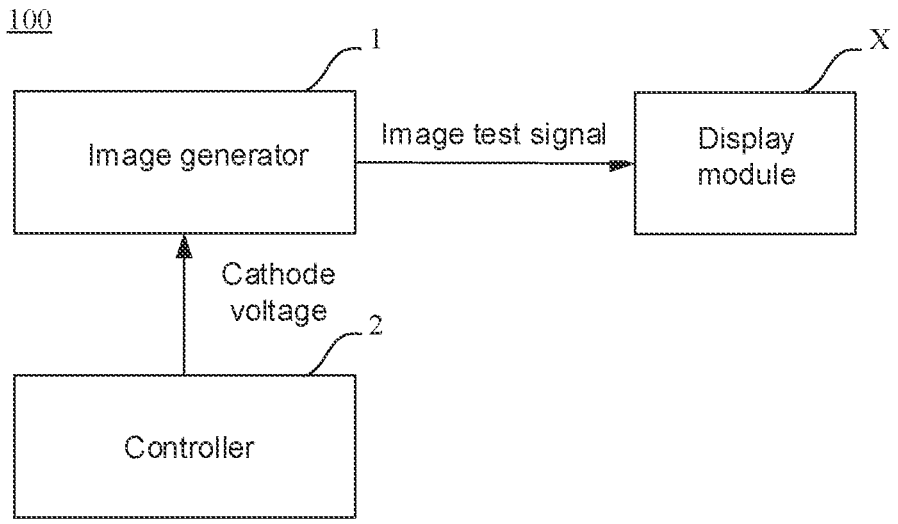
FIG. 4A is a structural diagram of a correction apparatus of a cathode voltage, in accordance with some embodiments.

As shown in FIG. 4A, in some embodiments, the correction method of the cathode voltage is implemented through a correction apparatus 100 of a cathode voltage, and the correction apparatus 100 of the cathode voltage includes an image generator 1 and a controller 2.

The image generator 1 is configured to generate image information, obtain the cathode voltage corresponding to the image information, and send a first image test signal including the image information and the cathode voltage to a display module X to be tested. The controller 2 is configured to control an optical measurement device to measure a first display parameter of the image displayed by the display module X to be tested according to the first image test signal, obtain the first display parameter from the optical measurement device, determine whether the first display parameter is within a display parameter threshold range, progressively adjust the cathode voltage according to the determination result, and send the adjusted cathode voltage to the image generator 1. The image generator 1 is further configured to obtain the adjusted cathode voltage, and send a second image test signal including the adjusted cathode voltage to the display module X to be tested. The controller 2 is further configured to use the second image test signal to test the display module X to be tested, and obtain a second display parameter until the corrected cathode voltage at the current brightness level is obtained. The corrected cathode voltage is a maximum cathode voltage corresponding to the displayed image corresponding to at least one display parameter, among all the first display parameter and the second display parameters, within the display parameter threshold range.

In the exemplary embodiments, the image generator 1 draws and sends the successfully drawn image to the display module X for display. The controller 2 may be a computer device, such as a computer or a mobile phone. The controller 2 controls the image generator 1 to perform drawing, and also controls the image generator 1 to send the image information to the display module X.

Optionally, the image generator 1 and the controller 2 may belong to the same device, such as the computer. Or, the image generator 1 and the controller 2 are two devices, and the two devices are electrically connected.

Figure 4B:
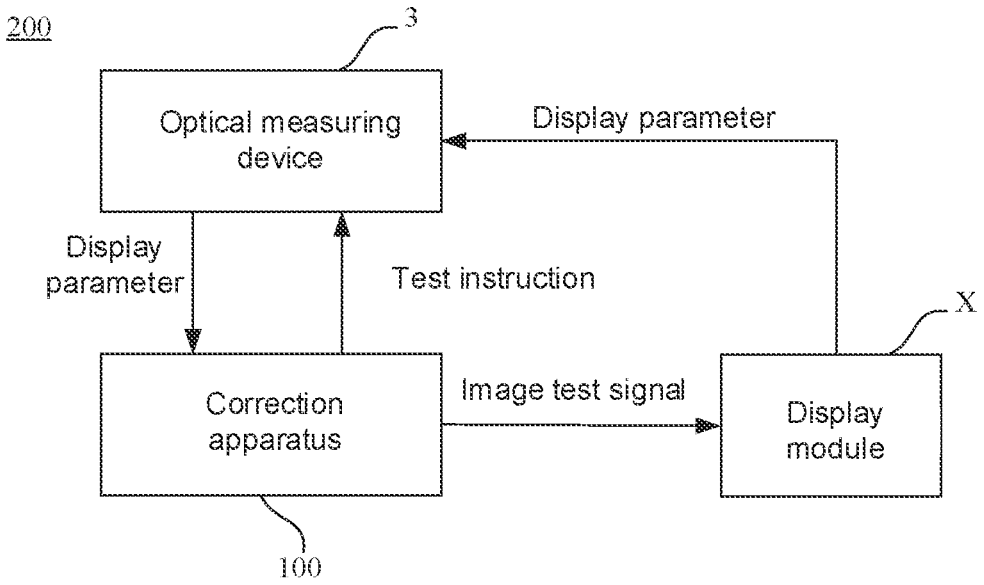
FIG. 4B is a structural diagram of a correction system of a cathode voltage, in accordance with some embodiments.

As shown in FIG. 4B, in some embodiments, the correction method of the cathode voltage is applied to a correction system 200 of the cathode voltage. The correction system 200 of the cathode voltage includes the above correction apparatus 100 and the optical measuring device 3. After the system is powered on, the cathode voltage of the display module X to be tested is corrected.

The optical measuring device 3 is configured to measure the display parameter of the image displayed by the display module X to be tested in response to a test instruction from the correction apparatus 100, and output the display parameter to the correction apparatus 100. The display parameter includes the first display parameter and the second display parameter.

In the exemplary embodiments, the optical measuring device 3 may be an optical probe, and it may directly capture parameters corresponding to the brightness information and the image color information of the image displayed on the display of the display module X.

In the exemplary embodiments, the controller 2 directly controls the optical measuring device 3 to measure the display parameter of the image; or, the controller 2 indirectly controls the optical measuring device 3 to measure the display parameter of the image through the image generator 1.

Referring to FIG. 4B, during the correction process of the cathode voltage, for each brightness level, the correction apparatus 100 sends an image test signal to the display module X to be tested, and sends a test instruction to the optical measuring device 3 at the same time. The optical measuring device 3 measures the display brightness of the display module X based on the test instruction sent by the correction apparatus 100 and feeds back the display parameter to the correction apparatus 100 for determination and further processing. The image test signal may be the first image test signal including the cathode voltage, and may also be the second image test signal including the adjusted cathode voltage.

In an optional embodiment, during the correction process of the cathode voltage, for each brightness level, the controller 2 of the correction apparatus 100 sends the image test signal to the display module X to be tested, and sends the test instruction to the optical measuring device 3 at the same time. The optical measuring device 3 measures the display brightness of the display module X based on the test instruction sent by the controller 2 and feeds back the display parameter to the controller 2 for determination and further processing.

For convenience of description in the embodiments of the present disclosure, the correction process of the cathode voltage in the correction system is referred to as a pre-gamma tuning process.

A display module X includes a plurality of brightness levels B(n) (n is a positive integer, and the maximum value of n corresponds to the total number of gamma curves of the display panel in the chip of the display module X to be corrected). Each gamma curve includes multiple nodes, the abscissa value corresponding to a node is the gray scale value (e.g., 0 to 255), and the ordinate value corresponding to the node is the gray scale brightness value. It will be noted that, since there is a corresponding relationship between the brightness and the voltage, the gray scale brightness value may be characterized by a corresponding gray scale voltage (gamma voltage). The display panel adjusts the pixel brightness according to the respective curve values of the corresponding gamma curve, and each curve value is the gray scale voltage corresponding to each node on the gamma curve. In the embodiments of the present disclosure, each brightness level B(n) corresponds to one gamma curve and one corrected cathode voltage.

Figure 5:
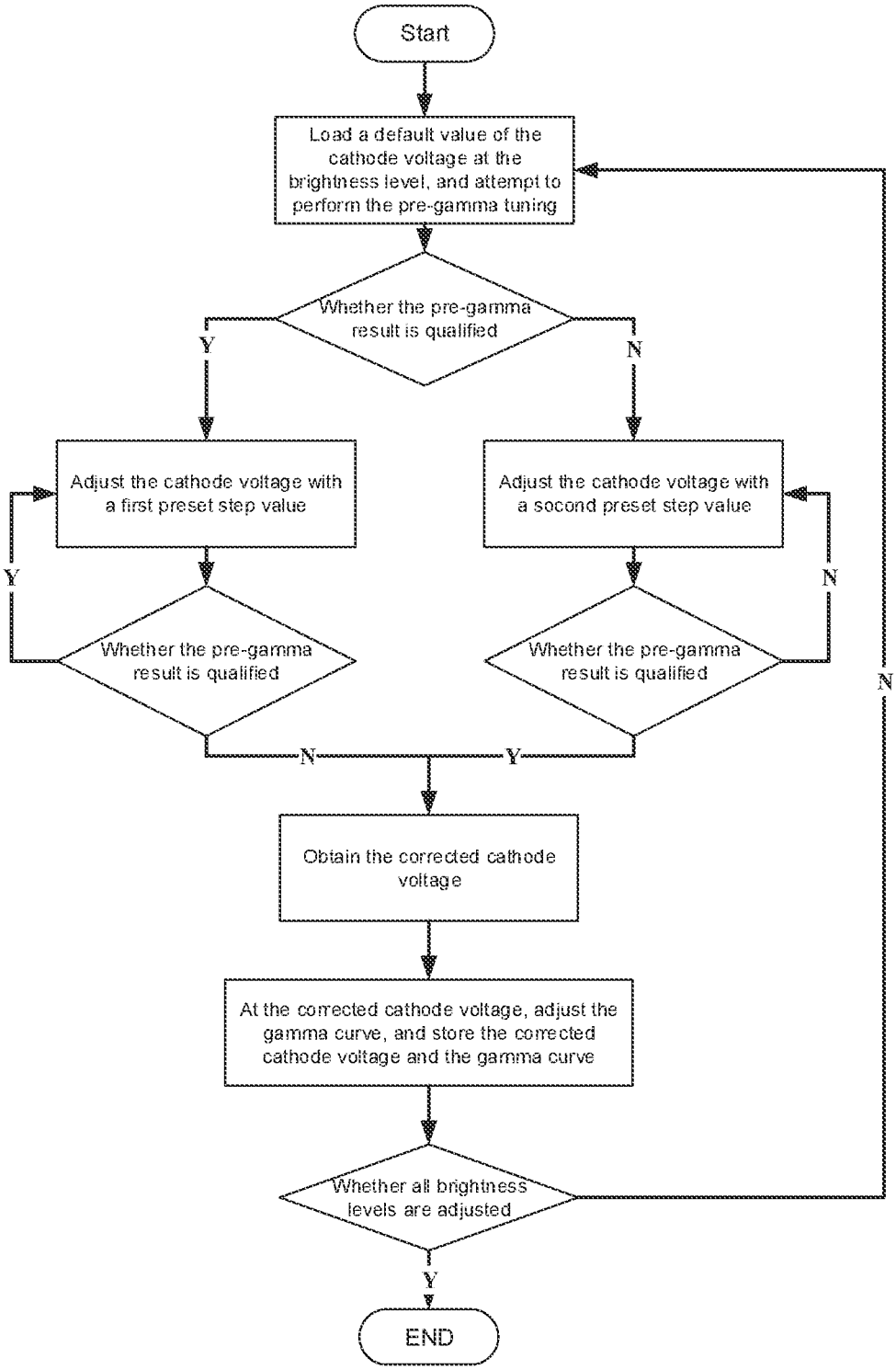
FIG. 5 is a diagram showing a process of correcting a cathode voltage, in accordance with some embodiments.

Based on the above, the correction method of the cathode voltage in the embodiments of the present disclosure will be further described in detail with reference to FIG. 5.

When the correction system 200 is started, the correction system 200 first attempts to perform a pre-gamma tuning for one brightness level B(n) among the plurality of brightness levels. For example, the correction may be started from the first brightness level B(1) among the plurality of brightness levels. The first brightness level B(1) is not particularly limited, and may be the first brightness level numbered according to the order stored in the memory. The controller 2 sends a first image test signal to the display module X to be tested according to the brightness level B(n). In this case, the cathode voltage in the first image test signal is the reference cathode voltage, which is also referred to as an ELVSS default value.

For each brightness level B(n) of each display module X to be tested, a cathode voltage default value is stored corresponding to the brightness level B(n). The cathode voltage default value may be a preset value of the cathode voltage for a batch of products when the display module X is produced, or may be a preset value of the cathode voltage according to the material used in the display module X. When the correction system 200 first attempts to perform the pre-gamma tuning for a brightness level B(n), the cathode voltage default value is used to measure the display module X to be tested; meanwhile, the optical measuring device 3 is used to measure the display module X and output the first display parameter.

When the correction system 200 first attempts to perform the pre-gamma tuning, the controller 2 sends a test instruction to the optical measuring device 3 to obtain the first display parameter, and determines whether the display effect of the image displayed by the display module X to be tested is qualified (that is, whether the first display parameter is with the display parameter threshold range) according to the obtained first display parameter. For example, the optical measuring device 3 measures and obtains the brightness information of the display module X to be tested based on the first image test signal at the current brightness level B(n) in response to the test instruction as the first display parameter, and the controller 2 may determine whether the display effect of the display module X to be tested under the measurement condition meets the display effect within the display parameter threshold range according to the first display parameter, and output the determination result.

The display parameter threshold may be a threshold of an optical spatial chromaticity coordinate when the display apparatus X can normally display in the optical index of the gray scale 255 image. Those skilled in the art can understand that this is not restrictive, and the display parameter threshold can be set corresponding to the parameter that can be measured by the optical measuring device 3, as long as the threshold can reflect the brightness information of the display module X to be tested during normal display.

The controller 2 may send the test instruction to the optical measuring device 3 according to preset debugging time to obtain the first display parameter, and the preset debugging time is time for the display module X to present the displayed image based on the current image test signal.

Based on the first display parameter being within the display parameter threshold range, a determination result that the display effect of the display module X to be tested is qualified is output; and based on the first display parameter being out of the display parameter threshold range, or the first display parameter being not obtained within the preset time, a determination result that the display effect of the display module X to be tested is not qualified is output.

Based on the determination result that the display effect of the display module X to be tested is qualified, the cathode voltage is adjusted with the first preset step value; the second image test signal including the adjusted cathode voltage is sent to the display module X to be tested until the display effect of the display module X to be tested is not qualified, and the cathode voltage in the second image test signal on which a previous test of the current test is based is output as the corrected cathode voltage.

Based on the determination result that the display effect of the display module X to be tested is not qualified, the cathode voltage is adjusted with the second preset step value; the second image test signal including the adjusted cathode voltage is sent to the display module X to be tested until the display effect of the display module X to be tested is qualified, and the cathode voltage in the second image test signal on which the current test is based is output as the corrected cathode voltage.

In some embodiments, based on the determination result that the display effect of the display module X to be tested is qualified, the cathode voltage is adjusted with the first preset step value, and the second image test signal including the adjusted cathode voltage is sent to the display module X to be tested, so that the controller 2 performs a determination again based on the adjusted cathode voltage.

If the determination result obtained by the controller 2 again is still that the display effect of the display module X to be tested is qualified, the controller 2 controls to adjust the cathode voltage with the first preset step value again based on the current cathode voltage (that is, the cathode voltage is further increased by the first preset step value), and causes the correction system to perform the pre-gamma tuning again using the re-adjusted cathode voltage as a new cathode voltage.

If the determination result obtained by the controller 2 again is changed into that the display effect of the display module X to be tested is not qualified for the first time, it means that the cathode voltage after increasing the first preset step value makes the image displayed by the display module X to be tested no longer meet the requirement of the normal display. In this case, the controller 2 determines that the cathode voltage before increasing the first preset step value is the optimal value of the cathode voltages corresponding to the current brightness level B(n), i.e., the corrected cathode voltage.

The controller 2 sends the corrected cathode voltage to the display module X to be tested, so that the display module X to be tested stores the current brightness level B(n) and the corrected cathode voltage parameter corresponding to the corrected cathode voltage at the current brightness level B(n). The stored corrected cathode voltage parameter corresponds to the corrected cathode voltage, so that a power control chip of the display module X may output the corrected cathode voltage according to the corrected cathode voltage parameter. Optionally, the current brightness level B(n) and the corrected cathode voltage parameter ELVSS-(n) corresponding to the current brightness level B(n) may be stored in the register of the display module X in the manner shown in FIG. 7.

In some other embodiments, based on the determination result that the display effect of the display module X to be tested is not qualified, the cathode voltage is adjusted with the second preset step value, and the second image test signal including the adjusted cathode voltage is sent to the display module X to be tested, so that the controller 2 performs a determination again based on the adjusted cathode voltage.

If the determination result obtained by the controller 2 again is still that the display effect of the display module X to be tested is not qualified, the controller 2 controls to adjust the cathode voltage with the second preset step value again based on the current cathode voltage (that is, the cathode voltage is further decreased by the second preset step value), and causes the correction system 200 to perform the pre-gamma tuning again using the re-adjusted cathode voltage as a new cathode voltage.

If the determination result obtained by the controller 2 again is changed into that the display effect of the display module X to be tested is qualified for the first time, it means that the cathode voltage after decreasing the second preset step value makes the image displayed by the display module X to be tested meets the requirement of the normal display for the first time. In this case, the controller 2 determines that the current cathode voltage is the optimal value of the cathode voltages corresponding to the current brightness level B(n), i.e., the corrected cathode voltage.

The controller 2 sends the corrected cathode voltage to the display module X to be tested, so that the display module X to be tested stores the current brightness level B(n) and the corrected cathode voltage parameter corresponding to the corrected cathode voltage at the current brightness level B(n). The stored corrected cathode voltage parameter corresponds to the corrected cathode voltage, so that the power control chip of the display module X may output the corrected cathode voltage according to the corrected cathode voltage parameter. Optionally, the current brightness level B(n) and the corrected cathode voltage parameter ELVSS-(n) corresponding to the current brightness level B(n) may be stored in the register of the display module X in the manner shown in FIG. 7.

The controller 2 uses the cathode voltage adjusted according to the preset step value (the first preset step value or the second preset step value) as the new cathode voltage to perform the pre-gamma tuning again. Similarly, the specific value of the preset step value is not intended to be limited here, and the minimum voltage value at which a testing device can measure the brightness parameter variation shall prevail when implementing the design. For example, the preset step value of adjusting the voltage may be set to 0.1V. Similar to the process of the first attempt to perform the pre-gamma tuning, the controller 2 sends the test instruction to the optical measuring device 3 to obtain the second display parameter, and determines whether the display effect of the display module X to be tested is qualified according to the obtained second display parameter and outputs the determination result.

In some embodiments, the correction method of a cathode voltage further includes: determining whether there is an uncorrected brightness level B(n), if so, adjusting the brightness level B(n) to the uncorrected brightness level B(n), and skipping to the process of first attempt to perform the pre-gamma tuning. For example, when the system starts, the first brightness level B(1) is first corrected, and then the second brightness level B(2) is subjected to a complete correction process may similar to the first attempt to perform the pre-gamma tuning process, and so on until all the cathode voltages corresponding to the brightness levels B(n) are corrected.

In some embodiments, the gamma curve at the brightness level B(n) corresponding to the corrected cathode voltage is adjusted at the corrected cathode voltage, and the corrected cathode voltage and the gamma curve are stored in the register, and then the correction process of cathode voltage of the correction system is finished.

Figure 6:
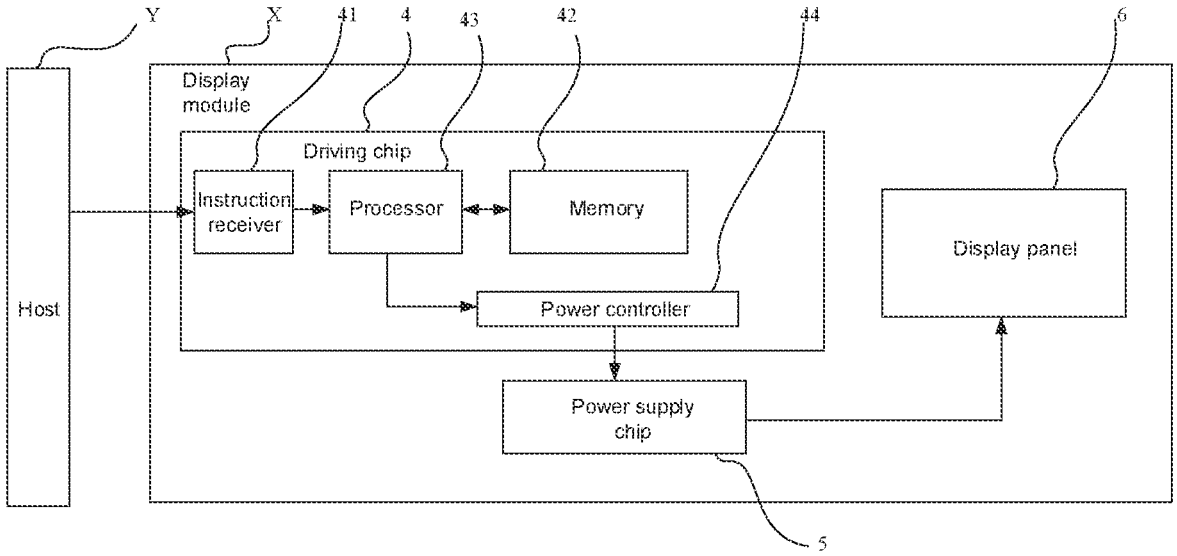
FIG. 6 is a structural diagram of a display module, in accordance with some embodiments.

As shown in FIG. 6, the embodiments of the present disclosure provide a display module X including a driving chip 4, a power supply chip 5 and a display panel 6.

The driving chip 4 is configured to store a plurality of brightness levels and a corrected cathode voltage parameter corresponding to each brightness level, determine the brightness level of a target image in response to a brightness adjustment instruction from a host Y, and output the corrected cathode voltage parameter corresponding to the determined brightness level.

The power supply chip 5 is configured to receive the corrected cathode voltage parameter, and output a corresponding corrected cathode voltage signal according to the corrected cathode voltage parameter, the corrected cathode voltage signal corresponds to the cathode voltage.

The display panel 6 is configured to receive the corrected cathode voltage signal and display an image at the corrected cathode voltage. Optionally, the display panel 6 may be an OLED display panel.

In some embodiments, as shown in FIG. 6, the driving chip 4 includes an instruction receiver 41, a memory 42, a processor 43 and a power controller 44.

The instruction receiver 41 is configured to receive the brightness adjustment instruction from the host Y.

The memory 42 is configured to store a configuration table, the configuration table includes the plurality of brightness levels, and the corrected cathode voltage parameter and the gamma curve corresponding to each brightness level.

Figure 7:
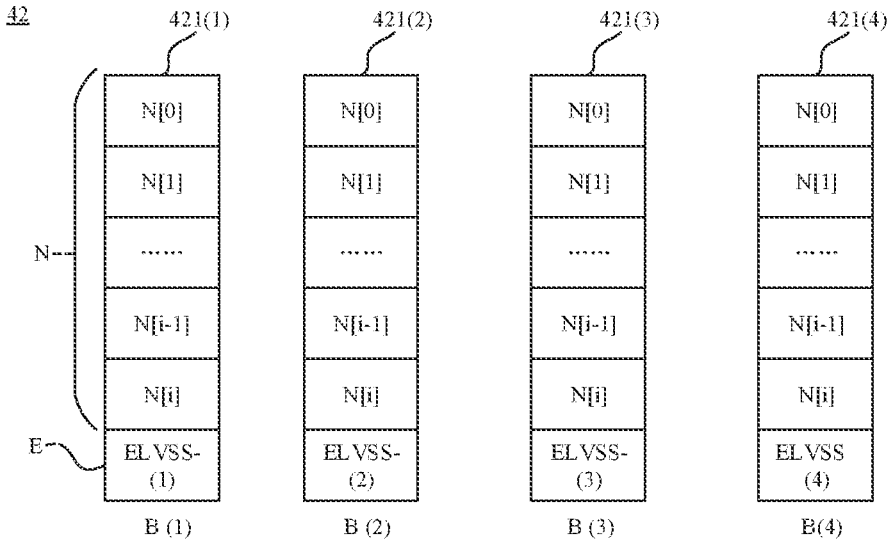
FIG. 7 is a structural diagram of a memory in a display module, in accordance with some embodiments.

For example, as shown in FIG. 7, the memory 42 includes multiple registers 421 (1~n), and each register 421 corresponds to a brightness level B(n). B(n) represents the n-th brightness level, for example, the first brightness level B(1) to the fourth brightness level B(4). The register 421 includes multiple gamma curve value storage bits N and one voltage parameter storage bit E. Each gamma curve value storage bit N is configured to store a curve value N[1 to i] corresponding to a node on the gamma curve corresponding to the brightness level B(n), and N[i] represents the curve value corresponding to the i-th node on the gamma curve. The voltage parameter storage bit E is configured to store a corrected cathode voltage parameter ELVSS-(1 to n) corresponding to the brightness level. It will be noted that, the "curve value" refers to the gray scale voltage corresponding to the node on the gamma curve.

The processor 43 is configured to determine the brightness level of the target image in response to the brightness adjustment instruction, query the memory 42 according to the brightness level and obtain the corrected cathode voltage parameter corresponding to the determined brightness level.

The power controller 44 is configured to send the corrected cathode voltage parameter acquired by the processor 43 to the power supply chip 5.

Optionally, the brightness levels and the corresponding corrected cathode voltage parameters stored in the driving chip 4 may be stored in the register 421 in the form shown in FIG. 7, so that when the driving chip 4 calls the brightness level in response to the input brightness adjustment instruction, it may directly call the corrected cathode voltage parameter corresponding to the brightness level at the same time.

In the embodiments of the present disclosure, the display module X stores the voltage parameter of the cathode voltage and the corresponding brightness level after being corrected by the correction method in the embodiments of the present disclosure. Therefore, the driving chip 4 may determine the brightness level and the corresponding corrected cathode voltage parameter only by receiving the brightness adjustment instruction, which may omit the step of sending parameters by the host, simplify the dynamic calling process of the product, and make the dynamic calling process of the cathode voltage simple and convenient. As a result, the universality and the convenience of the product may be improved, the competitiveness of the product may be improved, and the application prospect may be wide.

In some embodiments, the display module X may be in a state that has been corrected by the correction method of the cathode voltage in the embodiments of the present disclosure, for example, after factory correction. The display module X may be applied to electronic devices such as mobile phones, laptops, desktops, wearable devices. When the display module X is applied to one of these electronic devices, the host Y includes the processor of the electronic device. The host Y only needs to send the brightness adjustment instruction to the display module X according to the application scene. The display module X determines the brightness level in response to the brightness adjustment instruction, queries the memory 43 according to the brightness level and obtains the corresponding corrected cathode voltage parameter, and transmits the corrected cathode voltage parameter to the power supply chip 5 through the power controller. The power supply chip 5 loads the corresponding corrected cathode voltage to the display panel 6.

Figure 8A:
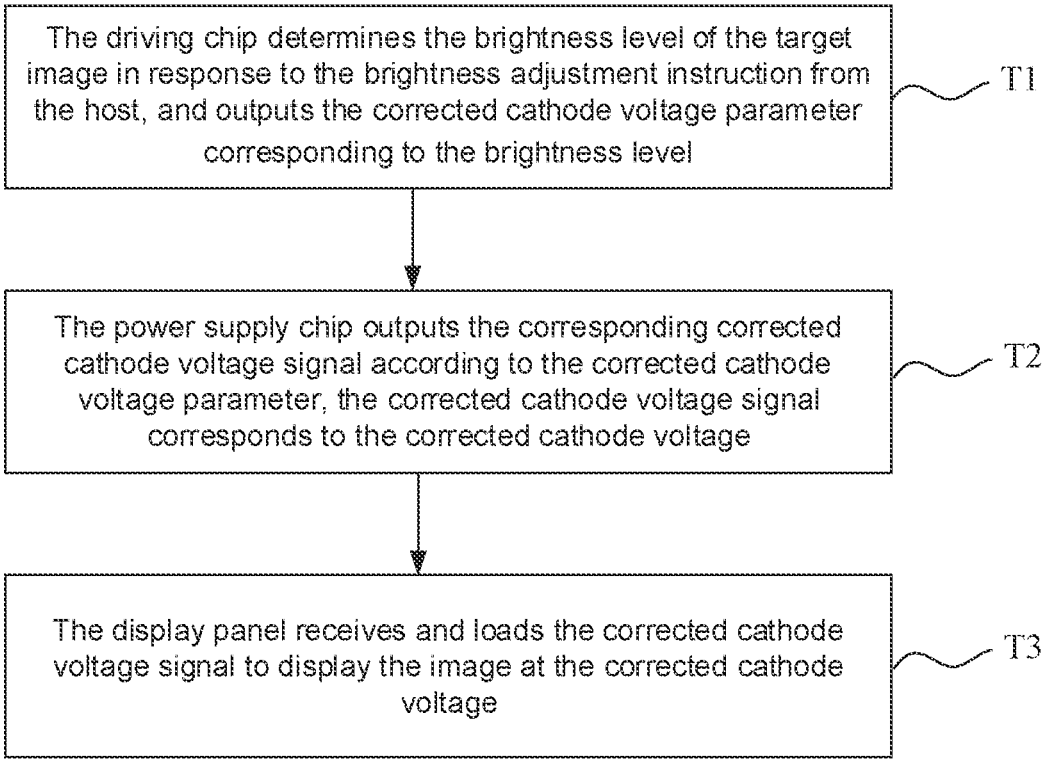
FIG. 8A is a flow diagram of a method of adjusting brightness of a display module, in accordance with some embodiments.

Based on the display module X in the embodiments of the present disclosure, the embodiments of the present disclosure further provides a method of adjusting brightness of the display module X. As shown in FIG. 8A, the method of adjusting the brightness of the display module X includes the following steps T1 to T3.

In T1, the driving chip determines the brightness level of the target image in response to the brightness adjustment instruction from the host, and outputs the corrected cathode voltage parameter corresponding to the brightness level.

Figure 8B:
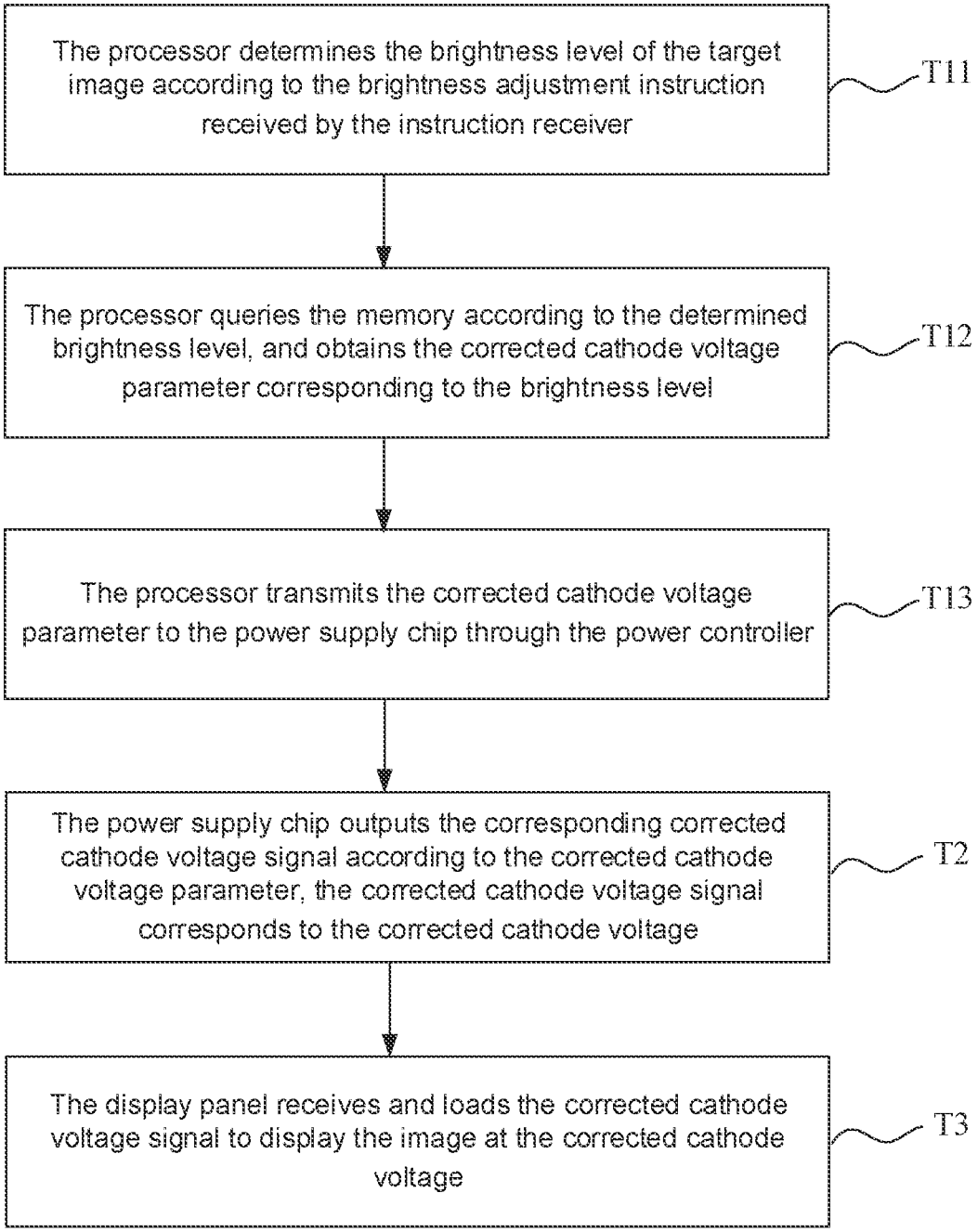
FIG. 8B is a flow diagram of another method of adjusting brightness of a display module, in accordance with some embodiments.

As shown in FIG. 8B, in some embodiments, T1 includes the following steps T11 to T13.

In T11, the processor determines the brightness level of the target image according to the brightness adjustment instruction received by the instruction receiver.

In T12, the processor queries the memory according to the determined brightness level, and obtains the corrected cathode voltage parameter corresponding to the brightness level.

In T13, the processor transmits the corrected cathode voltage parameter to the power supply chip through the power controller.

In T2, the power supply chip outputs the corresponding corrected cathode voltage signal according to the corrected cathode voltage parameter, the corrected cathode voltage signal corresponds to the corrected cathode voltage.

In T3, the display panel receives and loads the corrected cathode voltage signal to display the image at the corrected cathode voltage.

In some embodiments, the driving chip involved in the method of adjusting the brightness of the display module includes a processor 43, an instruction receiver 41, a memory 42, and a power controller 44 (referring to FIG. 6).

In the brightness adjustment method, the corrected cathode voltage obtained by the correction method in some embodiments of the present disclosure is pre-stored in the memory of the display module. When the brightness level needs to be adjusted, the driving chip may determine the brightness level and the corresponding corrected cathode voltage parameter only by receiving the brightness adjustment instruction, which may omit the step of sending parameters by the host, simplify the dynamic calling process of the product, and make the dynamic calling process of the cathode voltage simple and convenient. As a result, the universality and the convenience of the product may be improved, the competitiveness of the product may be improved, and the application prospect may be wide.

In some embodiments, a computer-readable storage medium is also provided, on which a computer program is stored, and when the computer program is executed by the processor, the correction method of the cathode voltage is achieved. The method includes: controlling the image generator to send the first image test signal to the display module to be tested at each brightness level of the display module to be tested; controlling the optical measuring device to measure the first display parameter of the image displayed by the display module to be tested according to the first image test signal; obtaining the first display parameter from the optical measuring device, and determining whether the first display parameter is within the display parameter threshold range; progressively adjusting the cathode voltage according to the determination result, and using the second image test signal including the adjusted cathode voltage to test the display module to be tested and obtain the second display parameter until the corrected cathode voltage at the current brightness level is obtained.

In some embodiments, a computer-readable storage medium is also provided, on which a computer program is stored, and when the computer program is executed by the processor, a method of adjusting the brightness of the display module is achieved. The method includes: the driving chip determining the brightness level of the target image in response to the brightness adjustment instruction from the host, and outputting the corrected cathode voltage parameter corresponding to the brightness level; the power supply chip outputting the corresponding corrected cathode voltage signal according to the corrected cathode voltage parameter; and the display panel receiving and loading the corrected cathode voltage signal to display the image.

In practical applications, the computer-readable storage medium may employ any combinations of one or more computer-readable media. The computer-readable medium may be a computer-readable signal medium or a computer-readable storage medium. A computer-readable storage medium may be, for example, but not limited to, an electrical, magnetic, optical, electromagnetic, infrared, or semiconductor system, apparatus, or device, or any suitable combination of the foregoing. More specific examples (a non-exhaustive list) of the computer-readable storage medium include: an electrical connection having one or more wires, a portable computer disk, a hard disk, a random access memory (RAM), a read-only memory (ROM), an erasable programmable read-only memory (EPROM), a flash memory, an optical fiber, a portable compact disc read-only memory (CD-ROM), an optical storage device, a magnetic storage device, or any suitable combination of the foregoing. In the embodiments, the computer-readable storage medium can be any tangible medium that include or store programs for use by an instruction execution system, apparatus or device or a combination thereof.

The computer-readable signal medium may include a data signal propagated in a baseband or as a part of a carrier, and computer-readable program codes are carried therein. Such propagated data signal may take many forms, including, but not limited to, electromagnetic signal, optical signal or any suitable combinations thereof. The computer-readable signal medium may further be any computer-readable medium besides the computer-readable storage medium, and the computer-readable medium may send, propagate or transmit a program for use by an instruction execution system, apparatus or device or a combination thereof.

The program codes included in the computer-readable medium may be transmitted with any suitable medium, including, but not limited to radio, electric wire, optical cable, radio frequency or the like, or any suitable combination thereof.

The computer program codes for performing the operations disclosed herein may be written in one or more programming languages or any combination thereof. These programming languages include an object-oriented programming language such as Java, Smalltalk, C++, and conventional procedural programming languages such as C programming language or similar programming languages. The program codes may be executed entirely on the user's computer, partly on the user's computer, as a stand-alone software package, partly on the user's computer and partly on a remote computer, or entirely on the remote computer or a server. In the scenario involving the remote computer, the remote computer may be connected to the user's computer through any type of network, including a local area network (LAN) or a wide area network (WAN), or connected to an external computer (for example, through the Internet using an Internet Service Provider).

Figure 9:
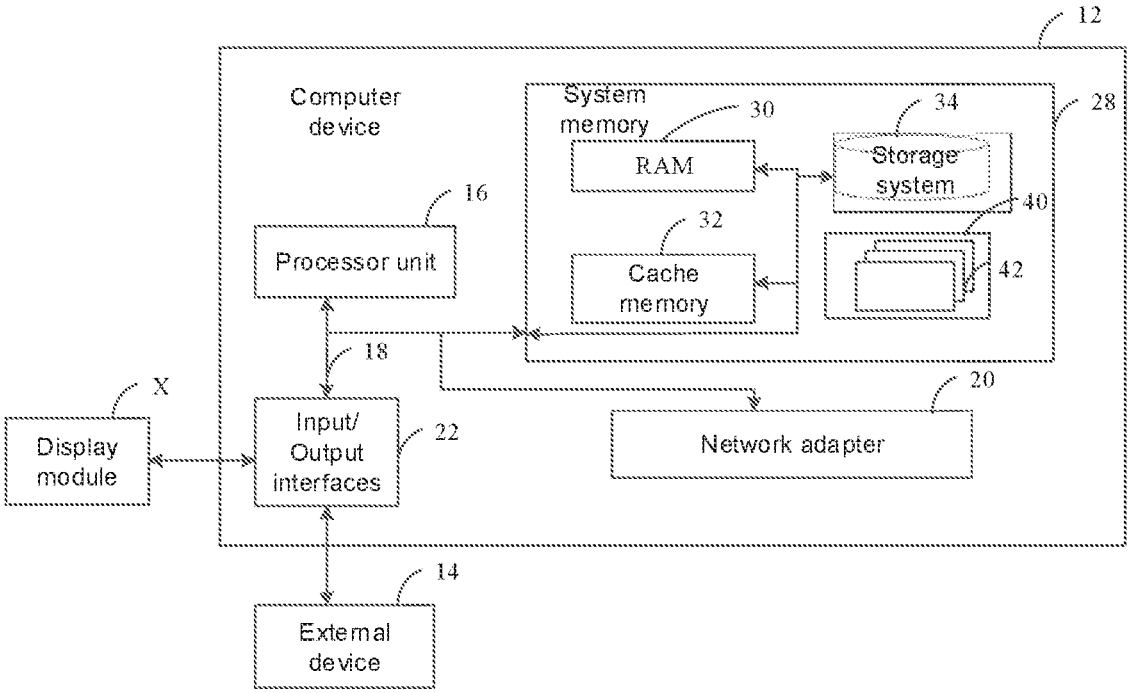
FIG. 9 is a structural diagram of a computer device, in accordance with some embodiments.

As shown in FIG. 9, in some embodiments, a computer device 12 is provided. The computer device 12 shown in FIG. 9 is only an example, and should not cause any limitations to the function and scope of use of the embodiments of the present disclosure.

As shown in FIG. 9, the components of the computer device 12 may include, but are not limited to, one or more processor units 16, a system memory 28, and a bus 18 that couples various system components (including system memory 28 and the processor unit 16).

The bus 18 represents one or more of several types of bus structures, including a memory bus or a memory controller, a peripheral bus, an graphics accelerated port, a processor or a local bus using any of a variety of bus structures. For example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

The computer device 12 includes a variety of computer system readable media. Such media may be any available media that are accessible by computer device 12, and include volatile and non-volatile media, and removable and non-removable media.

The system memory 28 can include computer system readable media in the form of volatile memory, such as a random access memory (RAM) 30 and/or a cache memory 32. The computer device 12 may further include other removable/non-removable and volatile/non-volatile computer system storage media. For example only, the storage system 34 can be provided for reading from and writing into a non-removable and non-volatile magnetic media (not shown in FIG. 9 and typically called a "hard drive"). Although not shown in FIG. 9, a magnetic disk drive for reading from and writing into a removable and non-volatile magnetic disk (e.g., a "floppy disk"), and an optical disk drive for reading from or writing into a removable and non-volatile optical disk (e.g., a CD-ROM, a DVD-ROM or other optical media) can be provided. In such instances, each drive can be connected to the bus 18 through one or more data media interfaces. The system memory 28 may include at least one program product having a set (e.g., at least one) of program modules that are configured to perform the functions of embodiments of the disclosure.

Program/utility 40, having a set (at least one) of program modules 42, may be, for example, stored in the system memory 28. Such program modules include, but are not limited to, an operating system, one or more application programs, other program modules and program data. Each or some combination of these examples may include an implementation of a networking environment. The program modules 42 may perform the functions and/or methods in the embodiments described of the present disclosure.

The computer device 12 may also communicate with one or more external devices 14 such as a keyboard, a pointing device, a the display module X; one or more devices that enable a user to interact with the computer device 12; and/or any device (e.g., network card, modem) that enables the computer device 12 to communicate with one or more other computer devices. Such communication can occur via Input/Output (I/O) interfaces 22. In addition, the computer device 12 may communicate with one or more networks (such as a local area network (LAN), a wide area network (WAN), and/or a public network (e.g., the Internet)) via a network adapter 20. As shown in FIG. 9, the network adapter 20 communicates with other components of the computer device 12 via the bus 18. It will be understood that although not shown in FIG. 9, other hardware and/or software components could be used in conjunction with the computer device 12, which include, but are not limited to: microcode, device drivers, redundant processors, external disk drive arrays, RAID (Redundant Arrays of Independent Disks) systems, tape drives, and data archival storage systems.

The processor unit 16 executes various functional applications and data processing by running the programs stored in the system memory 28, for example, implementing the correction method of the cathode voltage or the method of adjusting the brightness provided by the embodiments of the present disclosure.

In view of the current problems, a correction method, a correction apparatus and a correction system for the cathode voltage of the display module, a display module, a method of adjusting the brightness thereof, a computer-readable storage medium, and a computer device are formulated in the present disclosure. By providing the correction process of the cathode voltage, the display module is measured with a preset display parameter threshold range for each brightness level of the display module, the determination result is determined according to the display parameter, and the cathode voltage is progressively adjusted according to the determination result. In this way, the cathode voltage may be individually corrected to the optimal value according to the characteristics of each product, which avoids the disadvantages caused by the scheme of using the unified preset value, and may achieve the effect of improving the display effect while reducing the power consumption.

Moreover, the display module corrected using the above correction method, when adjusting the brightness, calls the corrected cathode voltage parameter stored in the driving chip of the display module, so that the step of sending parameters by the host in the related art may be omitted, thereby simplifying the dynamic calling process of the product, and making the dynamic calling process of the cathode voltage simple and convenient. As a result, the universality and the convenience of the product may be improved, the competitiveness of the product may be improved, and the application prospect may be wide.

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

What is claimed is:

1. A correction method of a cathode voltage, comprising:

controlling an image generator to send a first image test signal to a display module to be tested at each brightness level of the display module to be tested, wherein the first image test signal includes a cathode voltage, and is configured to drive the display module to be tested to display an image;

controlling an optical measuring device to measure a first display parameter of the image displayed by the display module to be tested according to the first image test signal;

obtaining the first display parameter from the optical measuring device, and determining whether the first display parameter is within a display parameter threshold range;

progressively adjusting the cathode voltage according to a determination result; and using a second image test signal including an adjusted cathode voltage to test the display module to be tested and obtain a second display parameter until a corrected cathode voltage at a current brightness level is obtained, wherein the corrected cathode voltage is a maximum cathode voltage corresponding to the displayed image corresponding to at least one display parameter, among all the first display parameter and the second display parameters, within the display parameter threshold range;

wherein the determination result is that the first display parameter is within the display parameter threshold range;

progressively adjusting the cathode voltage according to the determination result includes:

progressively adjusting the cathode voltage with a first preset step value; and using the second image test signal including the adjusted cathode voltage to test the display module to be tested and obtain the second display parameter until the corrected cathode voltage at the current brightness level is obtained, includes:

controlling the image generator to send the second image test signal including the adjusted cathode voltage to the display module to be tested;

obtaining, from the optical measuring device, the second display parameter of the image displayed by the display module to be tested according to the second image test signal;

determining whether the second display parameter is within the display parameter threshold range;

in response to determining that the second display parameter is within the display parameter threshold range, adjusting the cathode voltage with the first preset step value again, using a second image test signal including a re-adjusted cathode voltage to test the display module to be tested and obtain a second display parameter until the second display parameter is not within the display parameter threshold range, and using a cathode voltage in the second image test signal on which a previous test of the current test is based as the corrected cathode voltage; and in response to determining that the second display parameter is not within the display parameter threshold range, using a preset reference cathode voltage as the corrected cathode voltage, the preset reference cathode voltage being the cathode voltage included in the first image test signal before adjustment.

2. The correction method according to claim 1, wherein the cathode voltage is negative, and the first preset step value is positive.

3. The correction method according to claim 1, wherein the first display parameter and the second display parameter are each a chromaticity coordinate parameter corresponding to the image displayed by the display module to be tested under driving of a current cathode voltage, and the display parameter threshold range is a range of a standard chromaticity coordinate parameter corresponding to an image in an ideal state.

4. The correction method according to claim 1, further comprising:

storing a corrected cathode voltage parameter corresponding to each brightness level into the display module, the corrected cathode voltage parameter being a parameter corresponding to the corrected cathode voltage.

5. The correction method according to claim 1, further comprising:

adjusting a gamma curve corresponding to each brightness level based on the corrected cathode voltage at the brightness level.

6. The correction method according to claim 5, further comprising:

storing the adjusted gamma curve corresponding to each brightness level into the display module.

7. A non-transitory computer-readable storage medium storing a computer program; wherein when the computer program is executed by a processor, the correction method according to claim 1 is achieved.

8. A computer device including a memory, a processor, and a computer program stored on the memory and running on the processor; wherein when the processor executes the computer program, the correction method according to claim 1 is achieved.

9. A correction apparatus of a cathode voltage, comprising:

an image generator configured to generate image information, obtain a cathode voltage corresponding to the first image information, and send a first image test signal including the image information and the cathode voltage to a display module to be tested; and a controller configured to control an optical measuring device to measure a first display parameter of an image displayed by the display module to be tested according to the first image test signal, obtain the first display parameter from the optical measuring device, determine whether the first display parameter is within a display parameter threshold range, progressively adjust the cathode voltage according to a determination result, and send the adjusted cathode voltage to the image generator;

the image generator further configured to obtain the adjusted cathode voltage, and send a second image test signal including the adjusted cathode voltage to the display module to be tested;

the controller further configured to use the second image test signal to test the display module to be tested, and obtain a second display parameter until a corrected cathode voltage at a current brightness level is obtained, wherein the corrected cathode voltage is a maximum cathode voltage corresponding to the displayed image corresponding to at least one display parameter, among all the first display parameter and the second display parameters, within the display parameter threshold range;

wherein the determination result is that the first display parameter is within the display parameter threshold range;

progressively adjust the cathode voltage according to the determination result includes:

progressively adjusting the cathode voltage with a first preset step value; and using the second image test signal including the adjusted cathode voltage to test the display module to be tested and obtain the second display parameter until the corrected cathode voltage at the current brightness level is obtained, includes:

controlling the image generator to send the second image test signal including the adjusted cathode voltage to the display module to be tested;

obtaining, from the optical measuring device, the second display parameter of the image displayed by the display module to be tested according to the second image test signal;

determining whether the second display parameter is within the display parameter threshold range;

in response to determining that the second display parameter is within the display parameter threshold range, adjusting the cathode voltage with the first preset step value again, using a second image test signal including a re-adjusted cathode voltage to test the display module to be tested and obtain a second display parameter until the second display parameter is not within the display parameter threshold range, and using a cathode voltage in the second image test signal on which a previous test of the current test is based as the corrected cathode voltage; and in response to determining that the second display parameter is not within the display parameter threshold range, using a preset reference cathode voltage as the corrected cathode voltage, the preset reference cathode voltage being the cathode voltage included in the first image test signal before adjustment.

10. A correction system of a cathode voltage, comprising:

the correction apparatus according to claim 9; and the optical measuring device configured to measure a display parameter of the image displayed by the display module to be tested in response to a test instruction from the correction apparatus, and output the display parameter to the correction apparatus; the display parameter including the first display parameter and the second display parameter.

* * * * *